US007845877B2

(12) United States Patent
Gelfand et al.

(10) Patent No.: US 7,845,877 B2
(45) Date of Patent: Dec. 7, 2010

(54) ENHANCED VEHICLE BARRIER SYSTEM

(75) Inventors: Matthew A. Gelfand, Brentwood, TN (US); Brad Grubb, White House, TN (US)

(73) Assignee: Universal Safety Response, Inc., Franklin, TN (US)

( * ) Notice: Subject to any disclaimer, the term of this patent is extended or adjusted under 35 U.S.C. 154(b) by 340 days.

(21) Appl. No.: 11/803,445

(22) Filed: May 14, 2007

(65) Prior Publication Data

US 2008/0075529 A1 Mar. 27, 2008

Related U.S. Application Data

(63) Continuation of application No. 11/525,479, filed on Sep. 22, 2006, now abandoned.

(51) Int. Cl.
*E01F 13/08* (2006.01)

(52) U.S. Cl. ..... 404/6; 404/9; 49/49

(58) Field of Classification Search ..... 404/6, 404/9; 49/49; 256/13.1; 246/293
See application file for complete search history.

(56) References Cited

U.S. PATENT DOCUMENTS

| | | | | |
|---|---|---|---|---|
| 353,368 | A | 11/1886 | Miller | |
| 2,007,071 | A | 7/1935 | Burns | |
| 4,333,268 | A | 6/1982 | Dumbeck | |
| 4,844,653 | A | 7/1989 | Dickinson | |
| 5,146,710 | A | 9/1992 | Caldwell | |
| 5,228,237 | A | 7/1993 | Nasatka | |
| 5,245,787 | A | 9/1993 | Swenson et al. | |
| 5,639,178 | A | 6/1997 | Wilson et al. | |
| 5,871,329 | A | 2/1999 | Tidrick et al. | |
| 6,179,517 | B1 | 1/2001 | Nelson | |
| 6,189,839 | B1 * | 2/2001 | Lemieux | 246/293 |
| 6,485,225 | B1 | 11/2002 | Baker | |
| 6,655,090 | B2 | 12/2003 | Regner | |
| 6,902,151 | B1 | 6/2005 | Nilsson | |
| 6,962,328 | B2 | 11/2005 | Bergendahl | |
| 7,374,362 | B1 * | 5/2008 | Metzger | 404/6 |
| 7,641,416 | B2 * | 1/2010 | Miracle | 404/6 |
| 2005/0220536 | A1 | 10/2005 | Blair et al. | |
| 2007/0040405 | A1 | 2/2007 | Coble et al. | |
| 2007/0237577 | A1 | 10/2007 | Gelfand et al. | |

FOREIGN PATENT DOCUMENTS

| | | |
|---|---|---|
| WO | WO 2004/101893 | 11/2004 |

OTHER PUBLICATIONS

International Search Report, PCT/US07/20270, Apr. 8, 2008, 4 pages.

Written Opinion of the International Searching Authority, PCT/US07/20270, Apr. 8, 2008, 5 pages.

(Continued)

*Primary Examiner*—Gary S Hartmann

(57) ABSTRACT

An enhanced vehicle barrier system. The enhanced vehicle barrier system including bases located on opposite sides of an area through which a vehicle may pass, first and second arms hingably mechanically coupled to a base, first, second and third members, a raising/lowering mechanism, and a cable in mechanical communication with at least one of the first, second, and third members, the cable having connecting points located on opposite sides of the area through which a vehicle may pass, and wherein, in one position, at least portions of the first, second, and third members and the cable may be high enough to encounter a front of a vehicle.

21 Claims, 28 Drawing Sheets

OTHER PUBLICATIONS

Apr. 6, 2009 Office Action issued in U.S. Appl. No. 11/402,093.
Jul. 15, 2009 Response A to Apr. 6, 2009 Office Action issued in U.S. Appl. No. 11/402,093.
Nov. 10, 2009 Office Action issued in U.S. Appl. No. 11/402,093.
Apr. 9, 2010 Response B to Nov. 10, 2009 Office Action issued in U.S. Appl. No. 11/402,093.

* cited by examiner

ENHANCED VEHICLE BARRIER SYSTEM

This application is a continuation of U.S. patent application Ser. No. 11/525,479 for Enhanced Vehicle Barrier System, filed Sep. 22, 2006 now abandoned, which is hereby incorporated by reference, in its entirety.

BACKGROUND

This invention relates to an enhanced vehicle barrier system that may be used to stop a moving vehicle in a variety of applications, including traffic control, drawbridges, rail crossings, security gates, off-road, and crash cushion applications. While the enhanced vehicle barrier system of the present disclosure may be installed permanently, the arrangement of the enhanced vehicle barrier system of the present disclosure may facilitate assembly/disassembly and portability. The enhanced vehicle barrier system of the present disclosure may be used with a variety of anchors, such as nearby buildings or vehicles, such as trucks. The components of the enhanced vehicle barrier system have been designed to allow construction without or with limited use of tools, but tools may be used in the assembly process. If desired, more permanent connection members can be used in place of the couplings used to join certain elements of the system discussed below. Such substituted couplings may require the use of tools for assembly.

SUMMARY OF THE DISCLOSURE

The present disclosure relates to an enhanced vehicle barrier system. In one aspect, the enhanced vehicle barrier system includes a first base and a second base, located on opposite sides of an area through which a vehicle may pass, a first arm and a second arm, each hingably mechanically coupled to the first base, a first member hingably mechanically coupled to the first arm and extending in a direction across the area through which a vehicle may pass, a second member hingably mechanically coupled to the second arm and hingably mechanically coupled to the second base, a third member hingably mechanically coupled to the first member and hingably mechanically coupled to the first base, a raising/lowering mechanism in mechanical communication with the first arm and the second arm, and a cable in mechanical communication with at least one of the first, second, and third members, the cable having connecting points located on opposite sides of the area through which a vehicle may pass, wherein the raising/lowering mechanism moves the first and second arms, thereby moving the first, second, and third members, and the cable between a first position and a second position, and wherein, when in the second position, at least portions of the first, second, and third members and the cable are high enough to encounter a front of a vehicle.

DETAILED DESCRIPTION OF THE PREFERRED EMBODIMENTS

As used herein, the term absorb may mean to absorb, disperse, dissipate or redirect energy.

It may be understood that components in the system of the present disclosure may be fabricated using metal or similar strength material, including, but not limited to, polymers, elastomers, composites or other engineered materials.

Figure 1A:
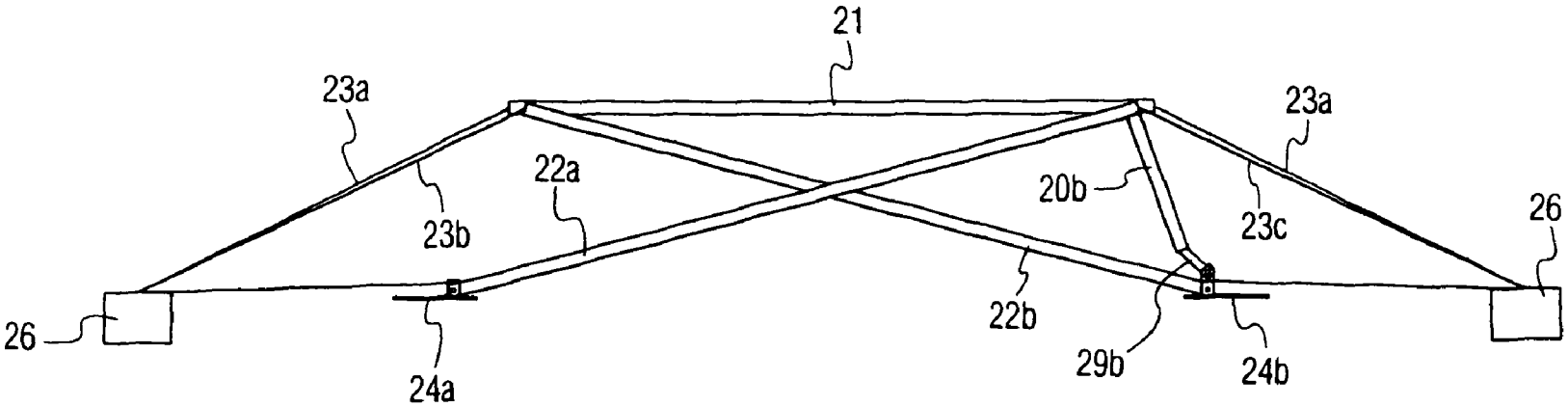
FIGS. 1A and 1B show front views of an enhanced vehicle barrier system, in raised and lowered positions, respectively, according to a first aspect of the present disclosure.
Figure 1B:
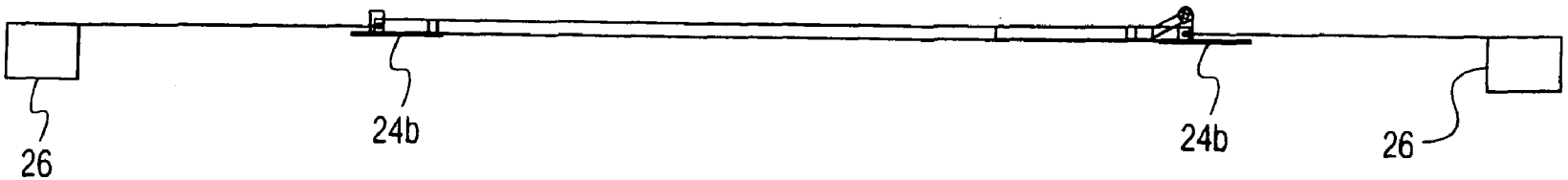
Figure 1C:
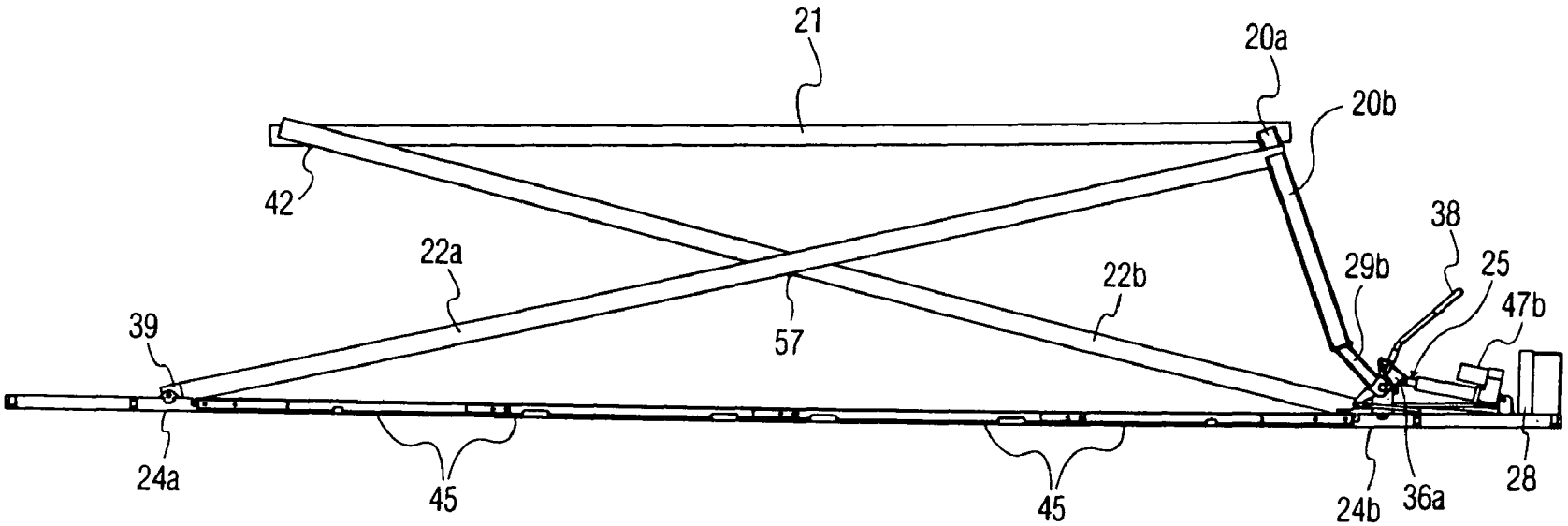
FIG. 1C shows a front view of an enhanced vehicle barrier system in raised position with an automatic raising/lowering mechanism, according to a first aspect of the present disclosure.
Figure 1D:
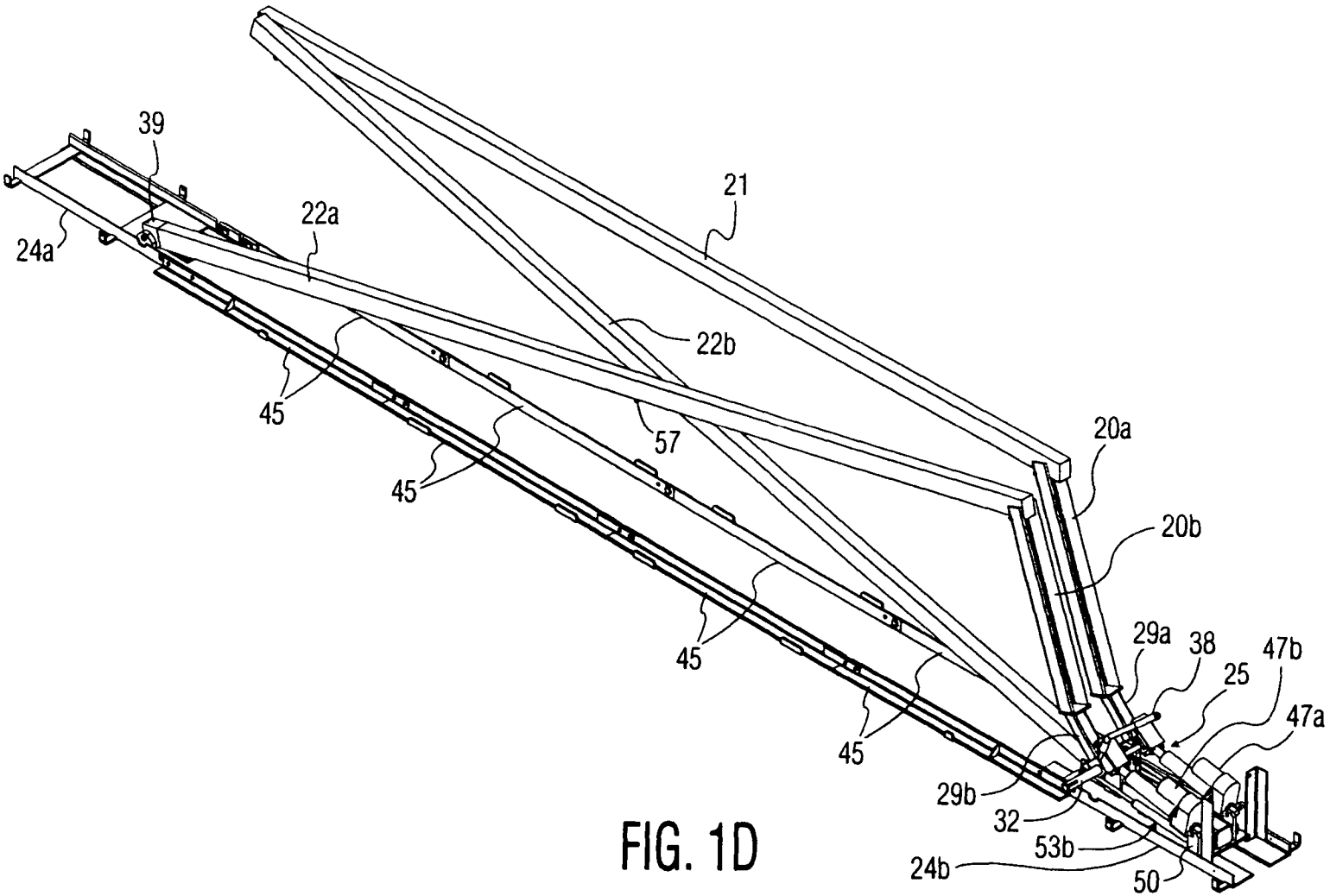
FIG. 1D shows a perspective view of an enhanced vehicle barrier system in raised position with an automatic raising/lowering mechanism, according to a first aspect of the present disclosure.

Referring to the drawings, wherein like reference numerals represent identical or corresponding parts throughout the several views, and more particularly to FIGS. 1A, 1B, and 1C showing front views of an enhanced vehicle barrier system, according to a first aspect of the present disclosure are shown. FIG. 1D shows a perspective view of an enhanced vehicle barrier system, according to a first aspect of the present disclosure. In a first aspect, the vehicle barrier system may include at least a first arm 20*a* and a second arm 20*b* (shown in FIG. 1D), a horizontal member 21, a first diagonal member 22*a* and a second diagonal member 22*b*, cables 23, bases 24, a manual and/or automatic raising/lowering mechanism 25 (shown in FIGS. 1D, 2, 3B and FIGS. 6-11), and anchors 26. Although depicted with cables and anchors, the enhanced vehicle barrier system could be constructed without anchors or cables.

Horizontal member 21 and first diagonal member 22*a* and second diagonal member 22*b* may extend at least partially across a roadway and may support cables 23, which may span the roadway. In FIGS. 1A and 1B, cable 23*a* may be supported by horizontal member 21, while cable 23*b* may be supported by first diagonal member 22*a* and cable 23*c* may be supported by second diagonal member 22*b*. Cables 23 may be fabricated from steel (wire rope) nylon fibers wrapped in polyester, or segmented-rigid components, such as a linked bar.

Cables 23*a*, 23*b*, and 23*c* may be mechanically coupled on either side of a roadway to anchors 26 using, for example, a heavy-duty D-link connector (not shown). Anchors 26 may be anything that resists movement and may be, for example, a vehicle. Anchors 26 may also have energy absorbing qualities.

Figure 5:
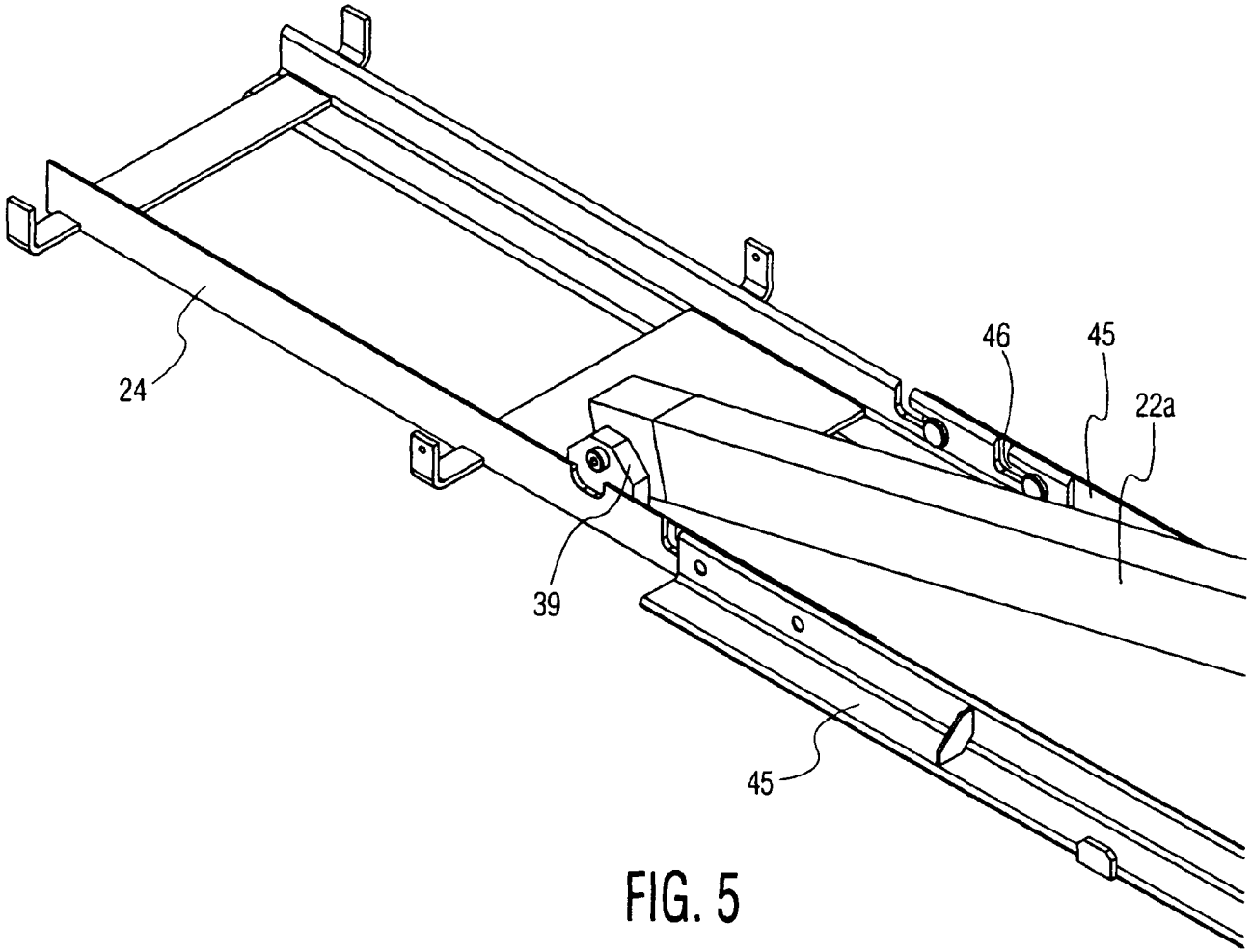
FIG. 5 shows a detailed perspective view of the mechanical coupling between a first diagonal member and a base of the enhanced vehicle barrier system in raised position, according to a first aspect of the present disclosure.

As shown in FIGS. 1C and 1D, the bases 24 may be connected to each other by a series of connecting linkages 45. The connecting linkages 45 may be connected to each other and to the bases 24 through groove connections 46 (as shown in FIG. 5). The connecting linkages 45 may be connecting angles as depicted in FIG. 1D. The connecting linkages help to keep the bases 24 connected together without requiring the bases 24 to be fixed to the ground. The connecting linkages 45 also provide a support from which to connect the ramps 56 (shown in FIG. 2).

Figure 2:
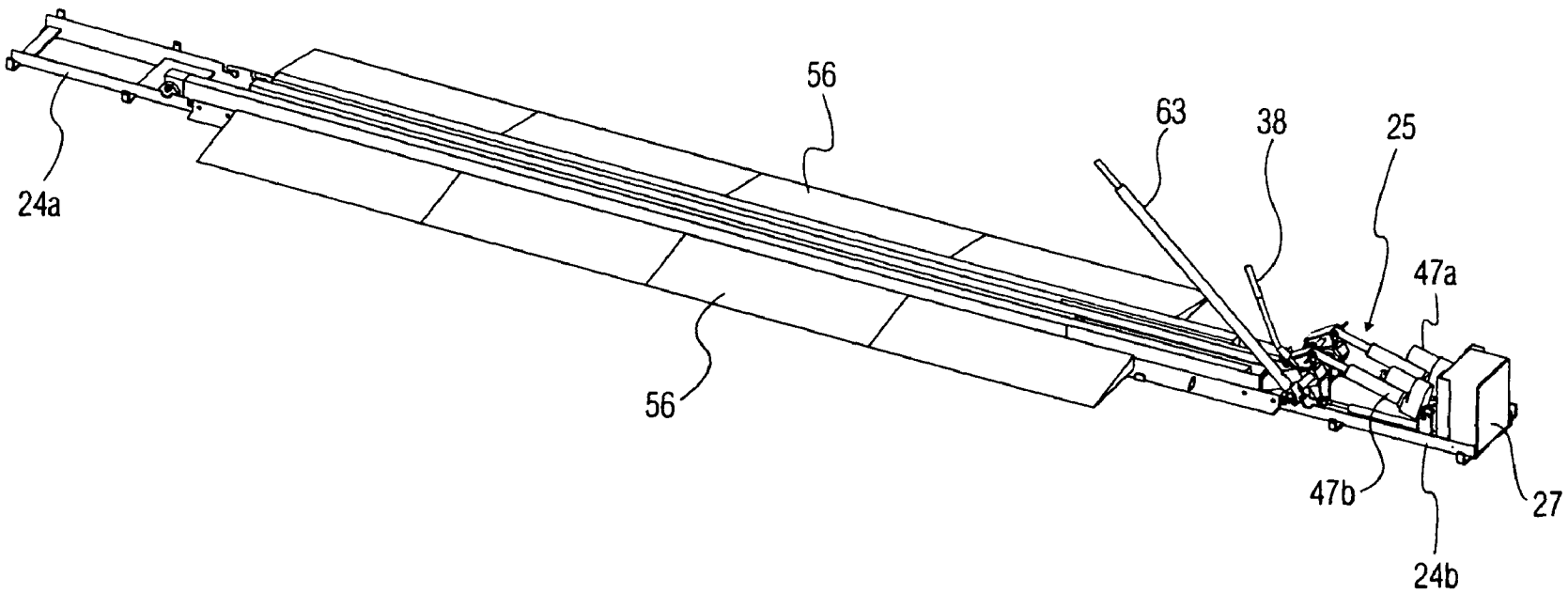
FIG. 2 shows a perspective view of an enhanced vehicle barrier system in lowered position with an automatic raising/lowering mechanism, according to a first aspect of the present disclosure.

As shown in FIG. 2, when in lowered position, the first arm 20*a*, second arm 20*b*, horizontal member 21, first and second diagonal members 22*a* and 22*b* may be substantially horizontal and/or parallel to ground level and low enough that a vehicle may pass over it using ramps 56 in a manner similar to a speed bump. In another aspect, the first arm 20*a*, second arm 20*b*, horizontal member 21, first and second diagonal members 22*a* and 22*b* may be embedded at or below ground level and ramps 56 may not be used.

Figure 3A:
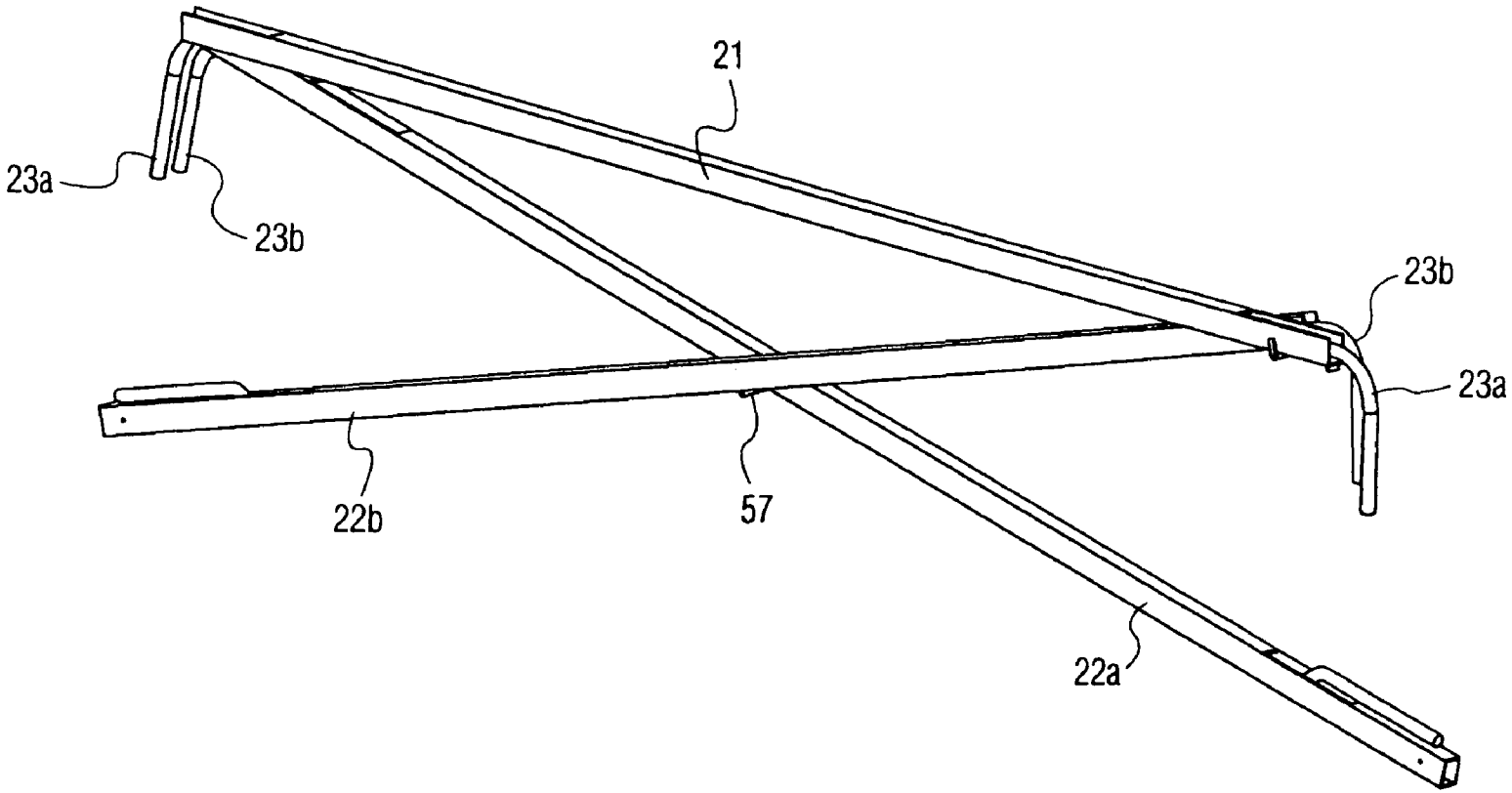
FIG. 3A shows a perspective view of a horizontal member coupled to first and second diagonal members, according to an aspect of the present invention.

Bases 24 may be arranged on opposite sides of a roadway and, when in a raised position, first and second diagonal members 22*a* and 22*b* may form an 'X' shape and may be mechanically coupled for example, using a pin 57 (as shown in FIG. 3A). The diagonal members 22*a* and 22*b* may also be coupled using a linear slide, groove, ring, or other connector (not shown).

Figure 3B:
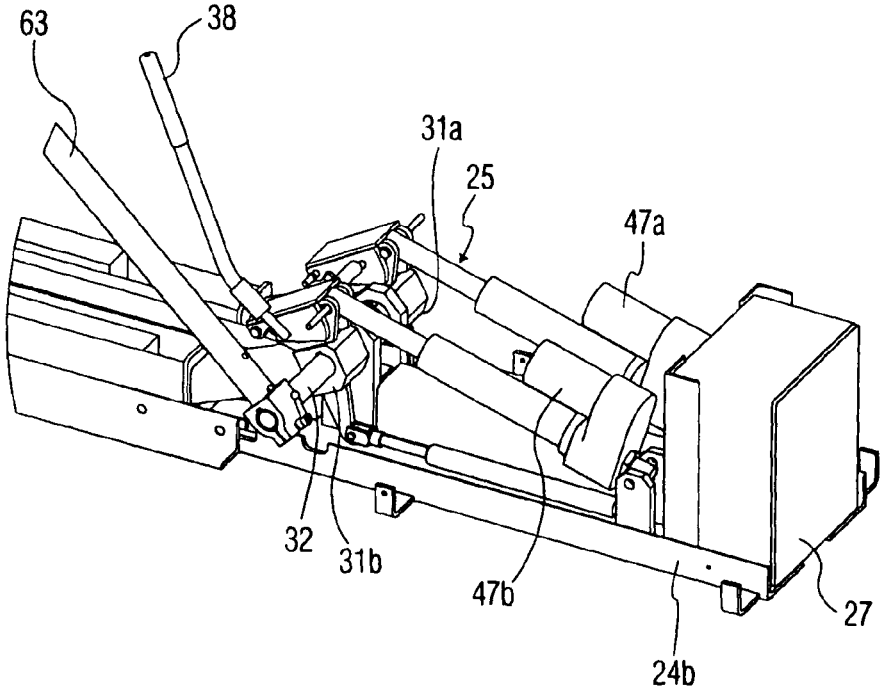
FIG. 3B shows a detailed perspective view of an automatic raising/lowering mechanism of the enhanced vehicle barrier system in lowered position, according to a first aspect of the present disclosure.

As shown in FIG. 3B, the automatic raising/lowering mechanism 25 may be electrically connected to and controlled by a control panel 27. The control panel 27 may be secured to the base 24*b* by mounting to vertical brackets 28.

Figure 3C:
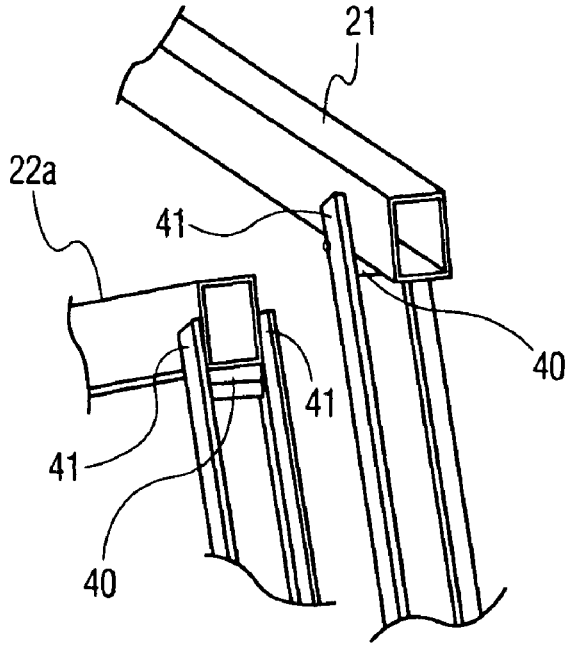
FIG. 3C shows a detailed perspective view of the mechanical coupling between a first arm and a horizontal member and a second arm and a second diagonal member of the enhanced vehicle barrier system in raised position, according to a first aspect of the present disclosure.

As shown in FIG. 3C, the horizontal member 21 may be coupled to the first arm 20*a* by resting on roller bearings 40 inside a slot 41 formed in the top of the first arm 20*a*. Similarly, the first diagonal member 22*a* may be coupled to the second arm 20*b* by resting on roller bearings 40 inside a slot 41 formed in the top of the second arm 20*b*.

Figure 3D:
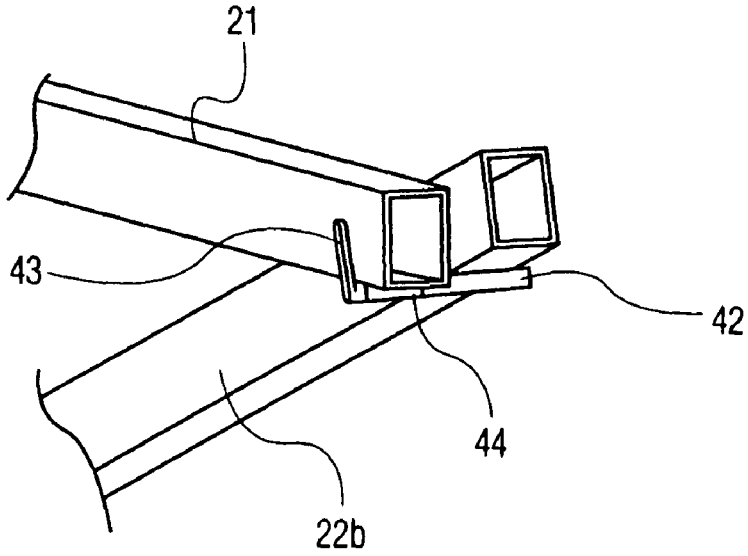
FIG. 3D shows a detailed perspective view of the mechanical coupling between a horizontal member and a first diagonal member of the enhanced vehicle barrier system in raised position, according to a first aspect of the present disclosure.

As shown in FIG. 3D, horizontal member 21 may be mechanically coupled to the second diagonal member 22*b* by resting on a pin 42 attached to the bottom of second diagonal member 22*b*. A lateral retainer 43 may be attached to pin 42 to constrain the horizontal member 21 laterally against the second diagonal member 22*b*. A sliding retainer 44 may be attached to horizontal member 21 to constrain the horizontal member and prevent it from sliding off pin 42. Pin 42, lateral retainer 43 and sliding retainer 44 may have roller bearings, or other means to reduce friction with the horizontal and diagonal members.

Figure 4:
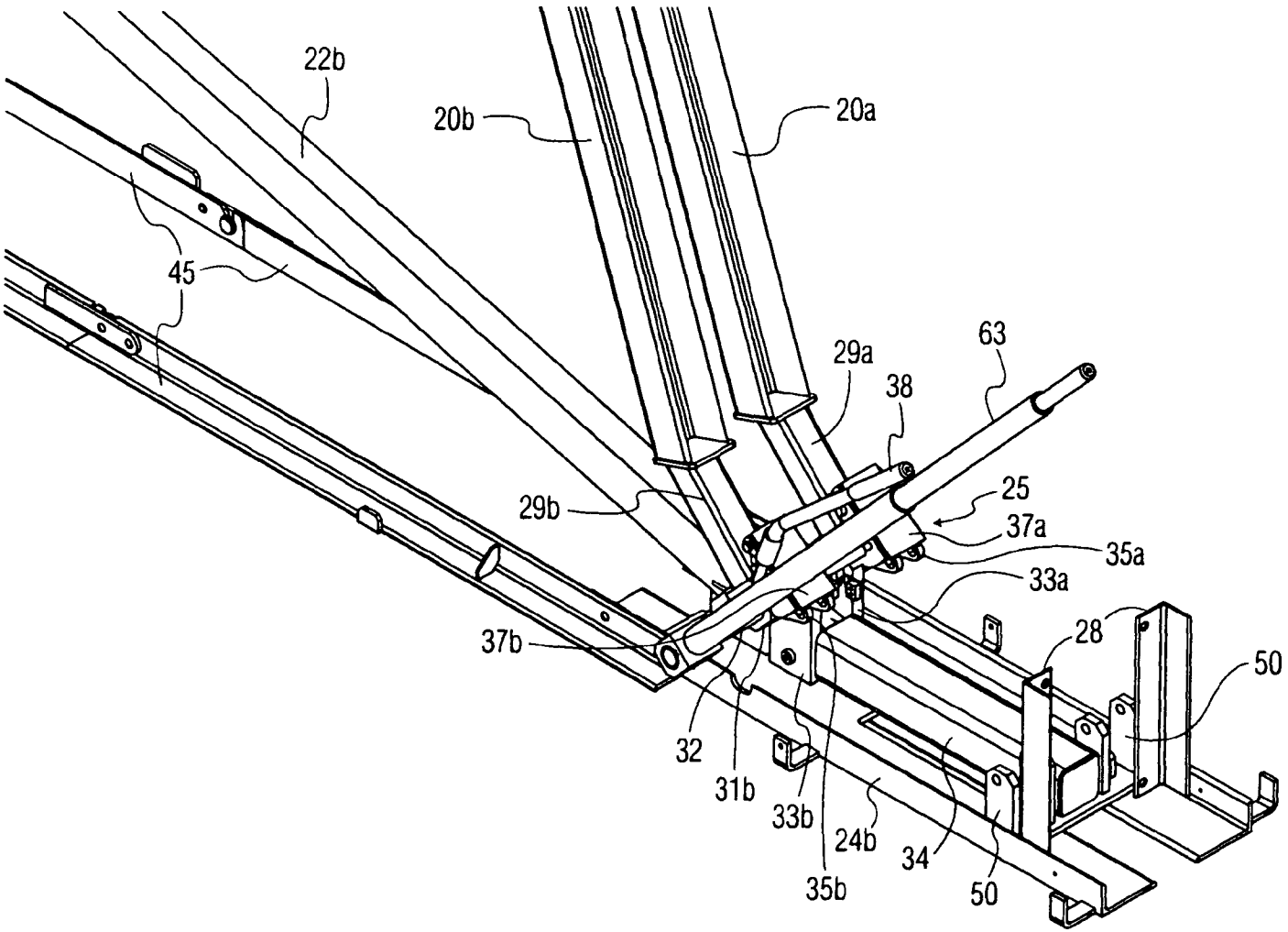
FIG. 4 shows a perspective view of a raising/lowering mechanism of the enhanced vehicle barrier system in raised position, according to an aspect of the present disclosure.

As shown in FIG. 4, first arm 20*a* may include an arm connector 29*a* and shaft housing connector 31*a*. Similarly, second arm 20*b* may include a second arm connector 29*b* and a second shaft housing connector 31*b*. The arm connectors 29*a* and 29*b* and shaft housing connectors 31*a* and 31*b* may be attached to the arms 20*a* and 20*b* by welding, bolt, pin, or other means, or may be formed with the arms 20*a* and 20*b* in one piece or may also be coupled to the arms 20*a* and 20*b* using a linear slide, groove, ring, or other connector (not shown). Shaft 32 may be coupled to shaft housing connectors 31*a* and 31*b* by welding, bolt, pin, or other means. Shaft 32 may also be a keyed shaft or may be formed in one piece with the shaft housing connectors 31*a* and 31*b*. Shaft 32 may be hingably mechanically coupled to base hinges 33*a* and 33*b* which may be secured to the bases 24*a* and 24*b* by welding, bolt, pin, or other means. Rigid member 34 may be placed on the bases 24*a* and 24*b* to provide extra support under the automatic raising/lowering mechanism 25 (shown in FIGS. 1D, 2, 3B and FIGS. 6-11). Rigid member 34 may be solid or hollow, and may resist flexing of the base 310 during the raising and lowering sequence.

As shown in FIG. 4, the raising/lowering mechanism 25 may include a shaft 32 in mechanical communication with both a first arm 20*a* and a second arm 20*b*. Raising/lowering mechanism 25 may be operated by turning a handle 63, which may cause shaft 32 to rotate and first arm 20*a* and second arm 20*b* to become raised.

In one aspect, as the shaft 32 rotates in a clockwise direction, one end of a horizontal member 21 may be raised through a mechanical connection to first arm 20*a*. As the shaft 32 rotates and the second arm 20*b* is raised, a first diagonal member 22*a* may also be raised through a mechanical connection to the second arm 20*b*. As the first diagonal member 22*a* is raised, a second diagonal member 22*b* may be raised through mechanical connection to the first diagonal member 22*a*, for example by pin 57 shown in FIGS. 1C and 1D. As the second diagonal member is 22*b* is raised, the other end of the horizontal member 21 may be raised by mechanical connection to the second diagonal member 22*b*. When in a raised position, horizontal member 21, diagonal members 22*a* and 22*b* and cables 23*a*, 23*b*, and 23*c* may be high enough to encounter a front of a vehicle.

Similarly, turning handle 63 may cause shaft 32 to rotate in a counter-clockwise direction and may cause first arm 20*a* and second arm 20*b* to become lowered. As the shaft 32 rotates, one end of a horizontal member 21 may be lowered through a mechanical connection to first arm 20*a*. As the shaft 32 rotates and the second arm 20*b* is lowered, a first diagonal member 22*a* may also be lowered through a mechanical connection to the second arm 20*b*. As the first diagonal member 22*a* is lowered, a second diagonal member 22*b* may be lowered through mechanical connection with the first diagonal member 22*a*. As the second diagonal member 22*b* is lowered, the other end of the horizontal member 21 may be lowered through mechanical connection to the second diagonal member 22*b*.

As shown in FIG. 5 (only diagonal member 22*a* is shown), the first and second diagonal members 22*a* and 22*b* may be coupled to the bases 24*a* and 24*b*, respectively, by use of one of a pair of pivot connectors 39 which may be coupled to each of the bases 24*a* and 24*b*. The diagonal members 22*a* and 22*b* may connected to the base by sliding down over an internal member (Shown in FIG. 3I) of the pivot connector 39.

Figure 6:
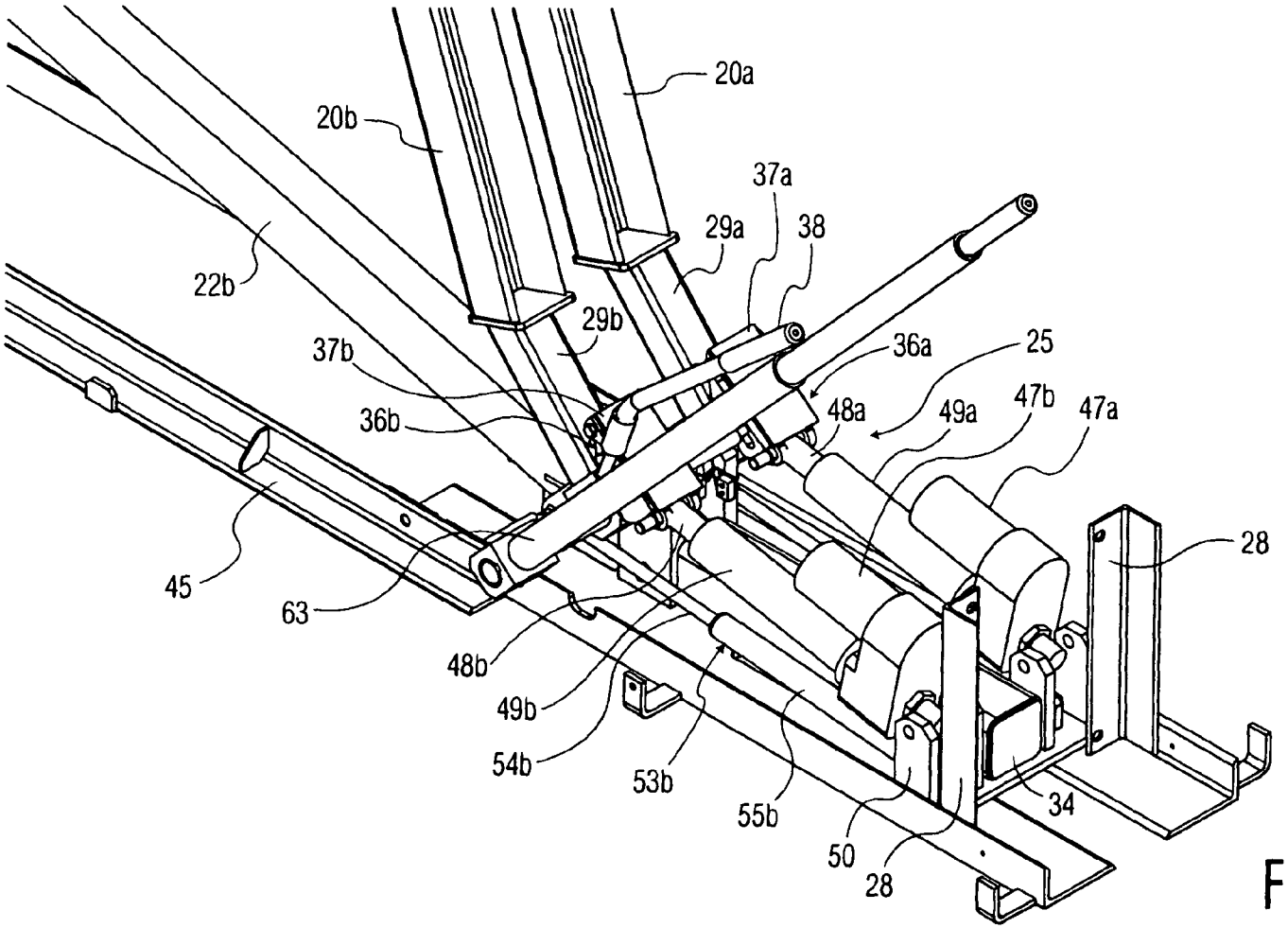
FIG. 6 shows a detailed perspective view of a raising/lowering mechanism of the enhanced vehicle barrier system in raised position, according to a first aspect of the present disclosure.
Figure 8:
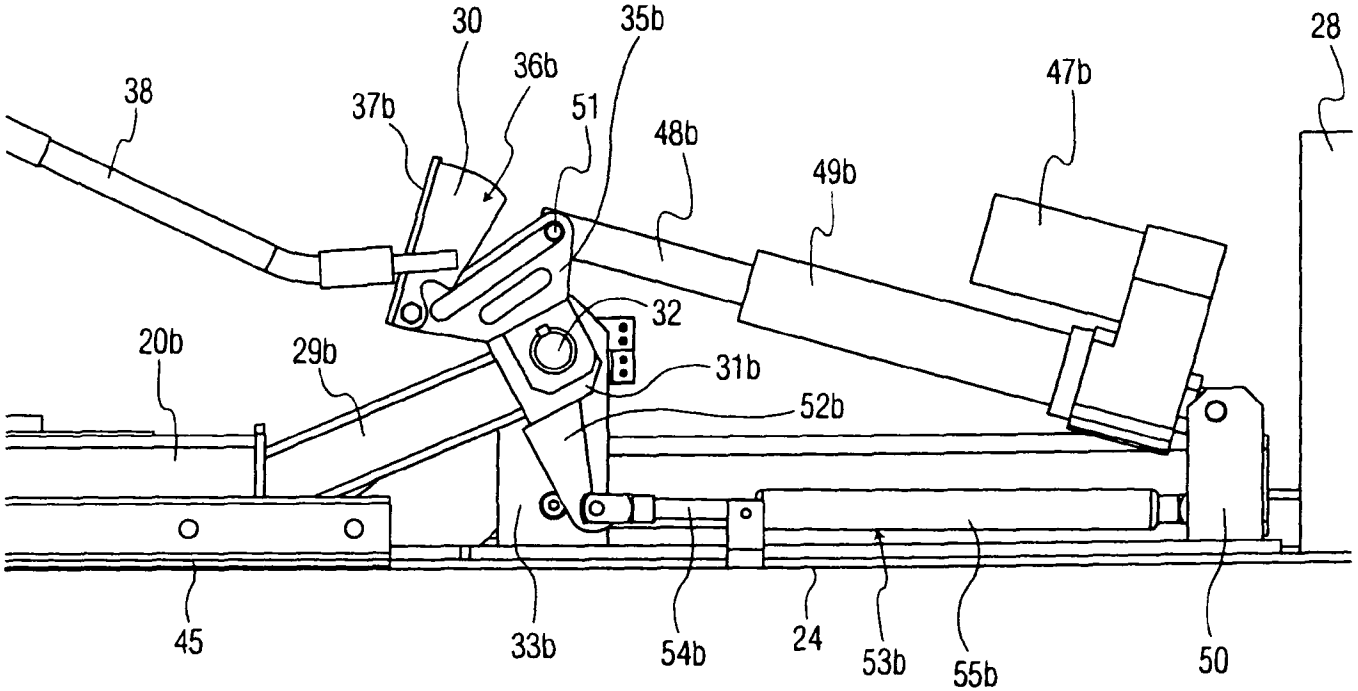
FIG. 8 shows a detailed side view of a raising/lowering mechanism of the enhanced vehicle barrier system in lowered position, according to a first aspect of the present disclosure.

As shown in FIG. 6, the raising/lowering mechanism 25 may include a first linear actuator 47*a* and also may include a second linear actuator 47*b*. The linear actuators 47*a* and 47*b* may be mechanically coupled to a base 24 and to the first and second arms, 20*a* and 20*b*, respectively. Each of the linear actuators 47*a* and 47*b* may be comprised of a motor mechanically engaged to a drive piston rod 48, which in turn may be housed in a drive cylinder 49 mounted to a base bracket 50. The drive piston rod 48 may be slidably coupled to manual release mount 35*b* by using a cross-pin 51 as shown in FIG. 8. The linear actuators 47*a* and 47*b* may be engaged (as shown for linear actuator 47*b* in FIG. 10) or disengaged (as shown for linear actuator 47*b* in FIG. 8) by raising and lowering the manual release latches 36*a* and 36*b*. When engaged, the linear actuators may be used to raise and lower the arms as described in more detail below. When disengaged, the arms may be raised and lowered manually as described in more detail below. The manual release handle 38 coupled to both manual release latches 36*a* and 36*b* can be used to simultaneously raise and lower both manual release latches.

As shown in FIGS. 7-11, second arm 20*b* may be coupled to a manual release mount 35*b*. Although not shown in the figures, first arm 20*a* may be similarly coupled to a manual release mount 35*a*. Manual release mounts 35*a* and 35*b* may be hingably mechanically coupled to manual release latch 36*a* and 36*b*, respectively. Manual release latches 36*a* and 36*b* may be comprised of notched cleavers 30 attached to latch plates 37*a* and 37*b*, respectively. A manual release handle 38 may be mechanically coupled to both manual release latches 36*a* and 36*b*.

Figure 10:
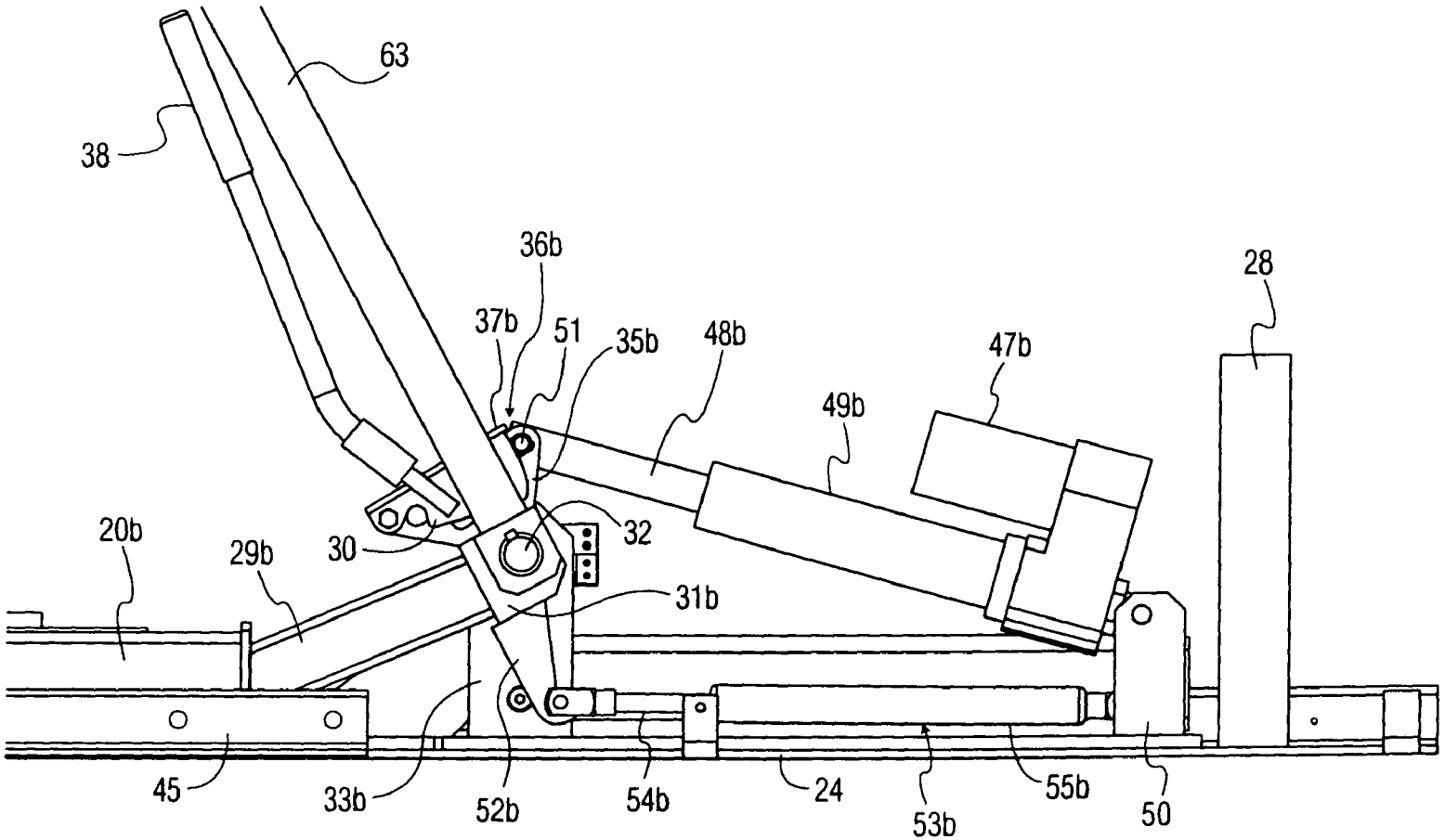
FIG. 10 shows a detailed side view of a raising/lowering mechanism of the enhanced vehicle barrier system in lowered position, according to a first aspect of the present disclosure.

As shown in FIG. 10, the linear actuator 47*b* may be engaged by lowering the manual release latch 36*b* and trapping the cross-pin 51 on the manual release mount 35*b* to the side of the notched cleaver 30. When the cross-pin 51 is locked in place on the side of the notched cleaver 30, the linear actuator 47*b* may impart a force on the manual release mount, which may act as a cam, rotating the shaft 32 to raise or lower second arm 20*b*. Although not shown in the figures, the manual release latch 36*a* also may lock a cross-pin 51 on the side of the notched cleaver 30, allowing linear actuator 47*a* to impart a force on the manual release mount 35*a*, rotating the shaft 32 and raising or lowering first arm 20*a*.

Figure 7:
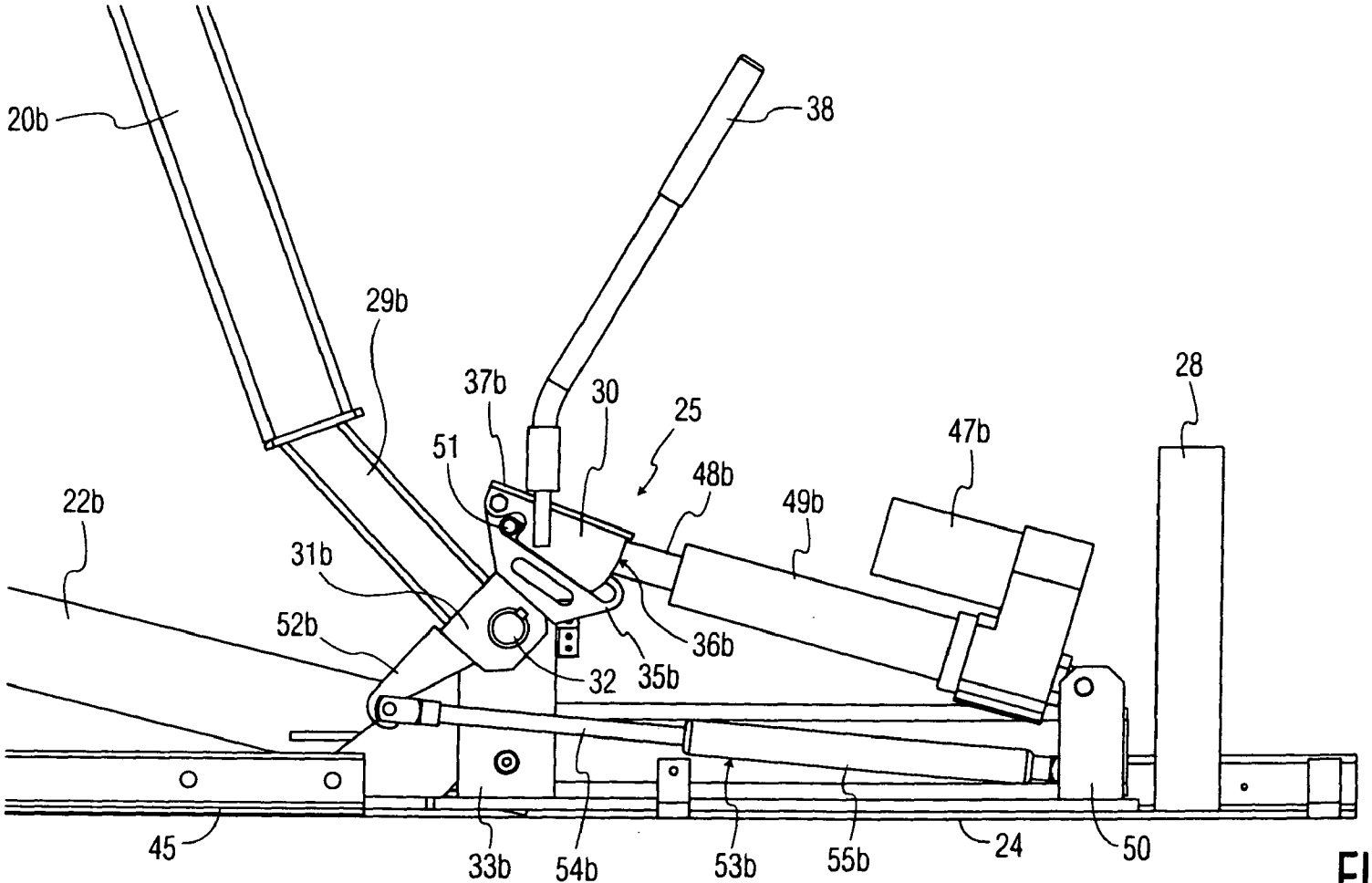
FIG. 7 shows a detailed side view of a raising/lowering mechanism of the enhanced vehicle barrier system in raised position, according to a first aspect of the present disclosure.
Figure 9:
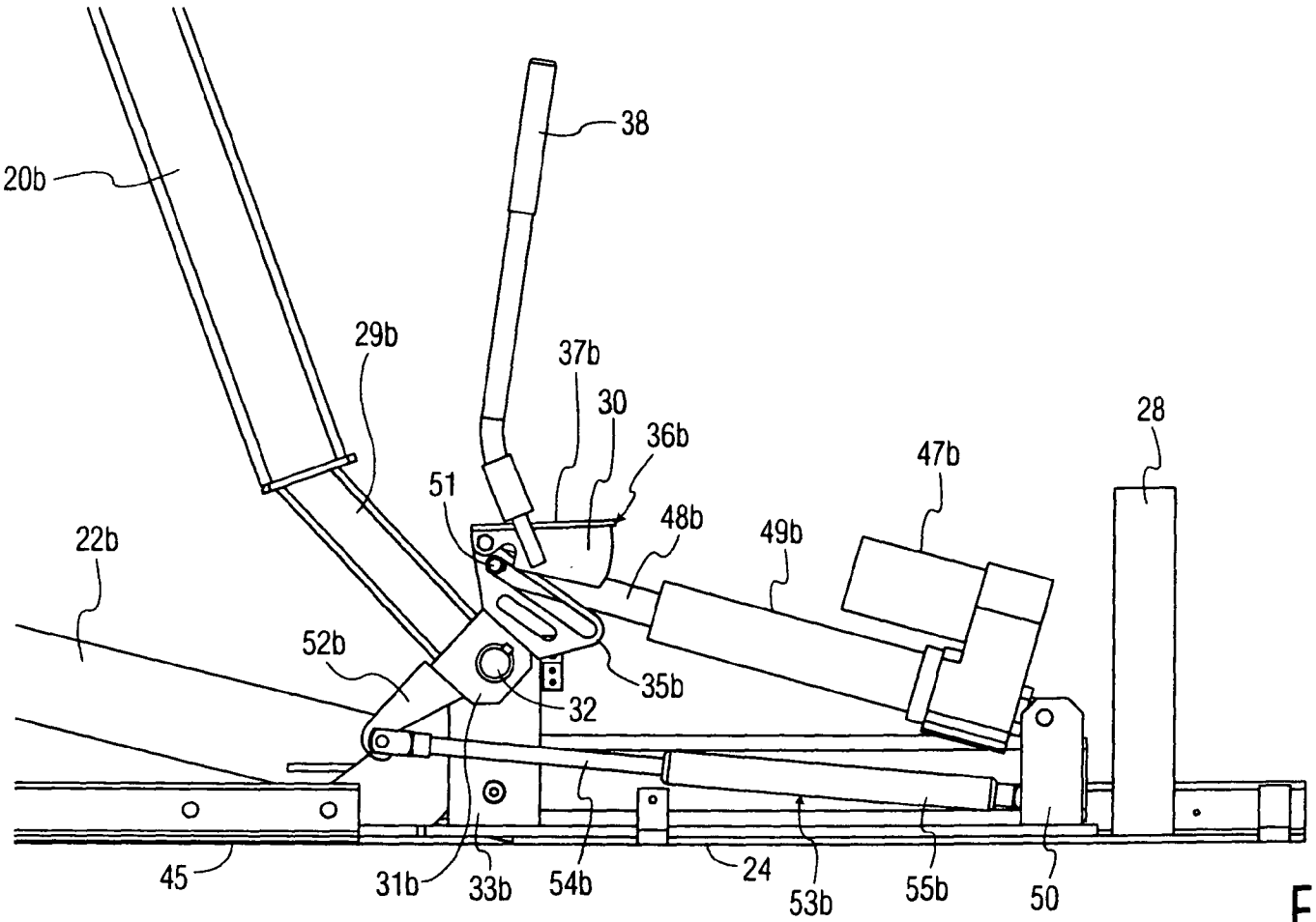
FIG. 9 shows a detailed side view of a raising/lowering mechanism of the enhanced vehicle barrier system in raised position, according to a first aspect of the present disclosure.

The manual release latches 36*a* and 36*b* may have two locking positions. FIG. 10 shows the manual release latch 36*b* locking the cross-pin 51 to the side of the notched cleaver 30, with the second arm 20*b* in a lowered position. FIG. 7 shows the manual release latch 36*b* locking the cross-pin 51 under the notched cleaver 30, with the second arm 20*b* in a raised position. By having two locking positions on the manual release latches, the raised horizontal and diagonal members and the arms can be locked in the raised position after being manually raised with the handle 63. When raised manually, the cross-pin 51 locks under the notched cleaver 30 in the raised position as shown in FIG. 7. By locking in the raised position as shown, the barrier members may be held up in the raised position by resistance from the linear actuators which are in a stopped position. After being lowered manually, the cross-pin 51 locks to the side of the notched cleaver 30 when in lowered position as shown in FIG. 10 to engage the linear actuators. Although not shown in the figures, it is possible to utilize a manual release latch with three or more positions, which can be engaged or disengaged regardless of the position of the arms. FIGS. 8 and 9 show the linear actuator 47*b* disengaged and with the manual release latch 36*b* not locking the cross-pin 51. The disengaged position may allow for manual raising or lowering of the second arm 20*b* by use of the handle 63 (shown in FIG. 6). Without disengaging the manual release latches from the cross-pins 51, the stopped linear actuators may provide enough resistance to prevent the shaft from turning and lowering the arms.

When engaged, as shown in FIG. 10, as the drive piston rod 48 moves outward, extending from the linear actuator 47*b*, the arm 20*b* may be lowered. As shown in FIG. 7, when the drive piston rod 48 retreats back into the linear actuator 47*b*, the arm 20*b* may be raised. Both linear actuators 47*a* and 47*b* may work together in the same manner to raise and lower arms 20*a* and 20*b*, respectively. In another aspect, arms 20*a* and 20*b* may be raised/lowered using a single linear actuator.

Figure 11:
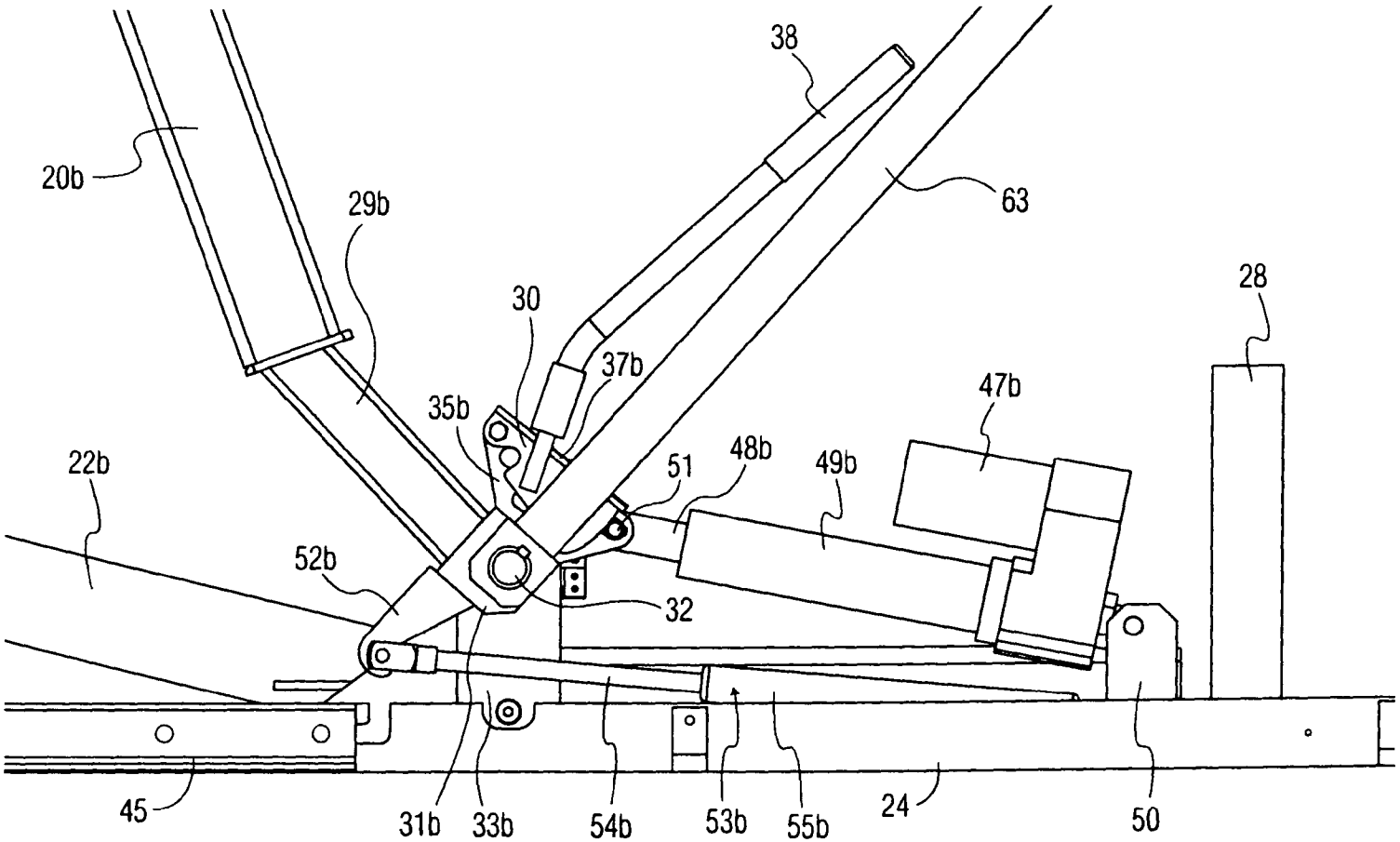
FIG. 11 shows a detailed and transparent view of a raising/lowering mechanism of the enhanced vehicle barrier system in raised position, according to a first aspect of the present disclosure.

As shown in FIG. 11, shaft housing connector 31*b* may be coupled to spring hook 52*b*. Similarly, shaft housing connector 31*a* (not shown) may be coupled to spring hook 52*a* (not shown). Raising/lowering mechanism 25 may include gas springs 53*a* (not shown) and 53*b* coupled to the base 24. Gas spring 53*b* may include a gas spring piston rod 54*b* and gas spring cylinder 55*b* providing resistance to movement. Similarly, gas spring 53*a* (not shown) may include a gas spring piston rod 54*a* (not shown) and gas spring cylinder 55*a* (not shown). Gas spring piston rods 54*a* and 54*b* may be coupled to hooks 52*a* and 52*b*, thereby assisting in the raising and lowering process by counterbalancing the weight of the arms and horizontal and diagonal members and allowing the gas springs to dampen both the raising and lowering motion of the arms 20*a* and 20*b*. As the arms 20*a* and 20*b* are raised, gas spring piston rods 54*a* and 54*b* move outward, extending from the gas spring cylinders 55*a* and 55*b*. When the arms are lowered, the gas piston rods 54*a* and 54*b* retreat back into the gas spring cylinders 55*a* and 55*b* (as shown in FIG. 10 for gas spring 53*b*). The gas spring 53*a* (not shown) behaves in a similar manner as shown for arm 20*b*, when arm 20*a* is raised and lowered.

Figure 3E:
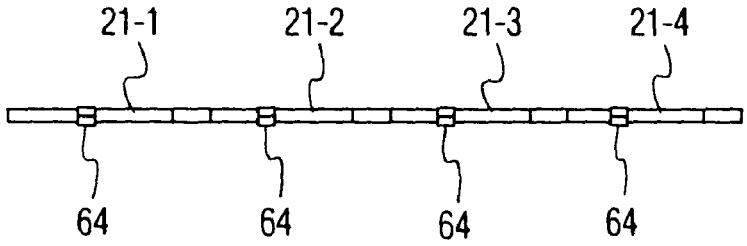
FIG. 3E shows a front view of an assembled horizontal member, according to a first aspect of the present disclosure.
Figure 3F:
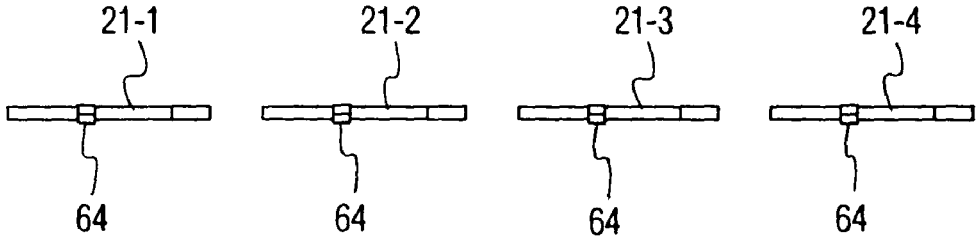
FIG. 3F shows a front view of a horizontal member with sections separated, according to a first aspect of the present disclosure.
Figure 3G:
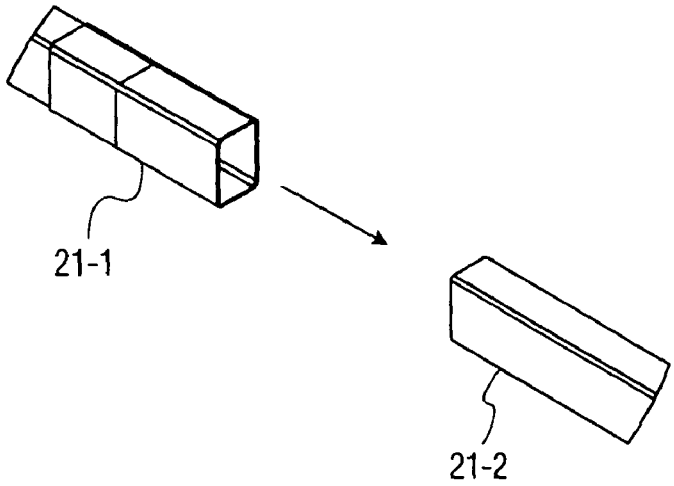
FIG. 3G shows a close-up perspective view of a horizontal member with sections separated, according to a first aspect of the present disclosure.
Figure 3H:
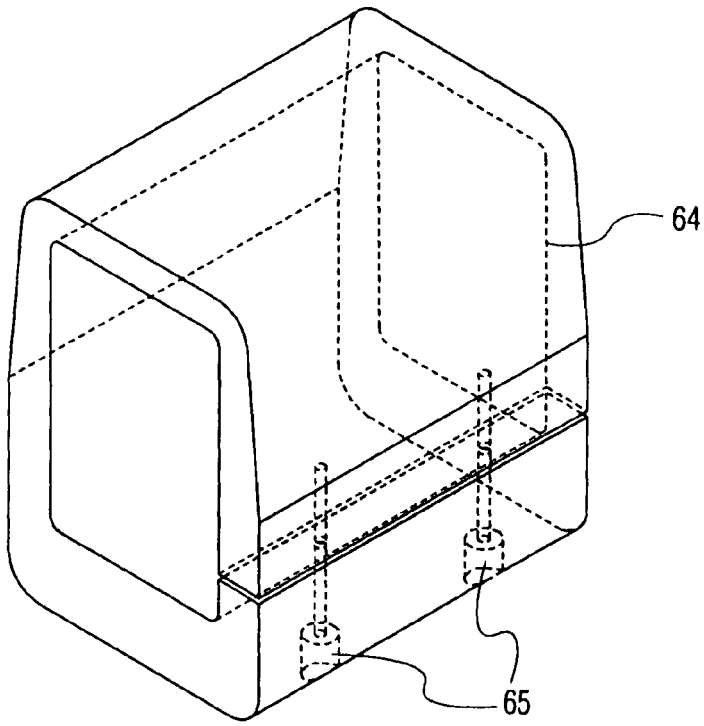
FIG. 3H shows a close-up perspective view of a horizontal member ring, according to a first aspect of the present disclosure.
Figure 3I:
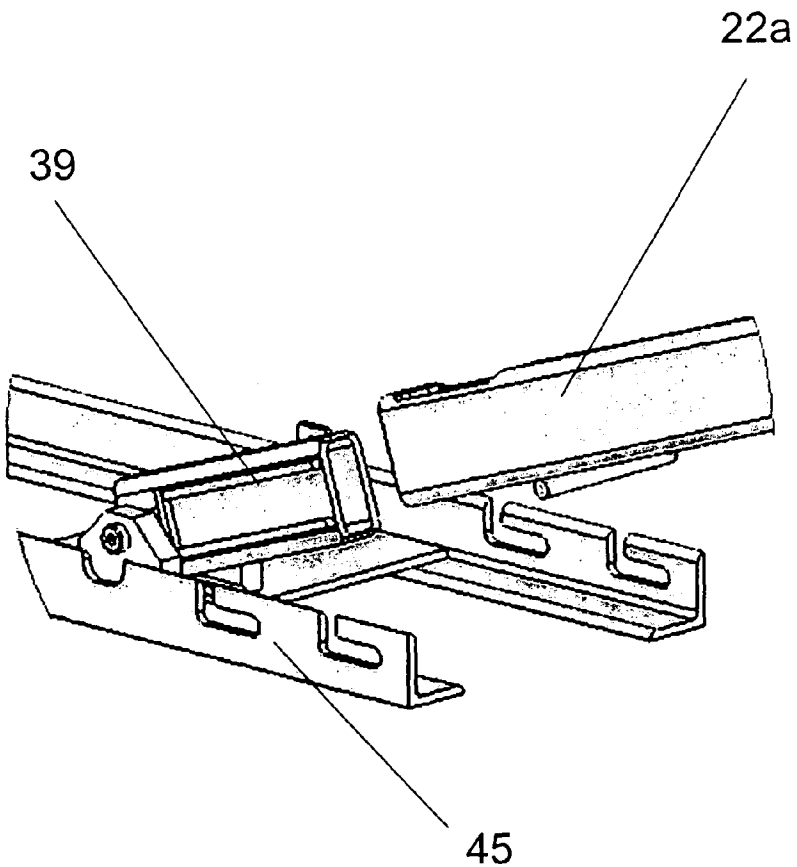
FIG. 3I shows a close-up perspective view of connecting linkage, pivot connector, and diagonal member, according to a first aspect of the present disclosure.

As shown in FIGS. 3E and 3F, horizontal member 21 may be formed of interlocking segments, such as 21-1, 21-2, 21-3 and 21-4 which may be disassembled for storage or transport. Segments 21-1, 21-2, 21-3 and 21-4 may be connected by sliding a portion of one segment into another as shown in FIG. 3G. Although not shown, diagonal members 22*a* and 22*b* may similarly be formed of interlocking segments. As shown in FIGS. 3E and 3F, a series of rings 64 may be placed over the horizontal member 21. Although not shown, rings 64 may also be placed on the first and second diagonal members 22*a* and 22*b*. The rings 64 may provide protection and shock absorption when the rigid horizontal and diagonal members are raised and lowered. A detailed view of the rings 64 is shown in FIG. 3H. Rings 64 may be constructed in two parts and secured by fasteners 65. For example, rings 64 may be made of rubber or plastic or other material that provides shock absorption.

First and second arms 20*a* and 20*b*, horizontal member 21 and first and second diagonal members 22*a* and 22*b* may be fabricated of expanded metal, or plastic, such as PVC. At least a portion of first and second arms 20*a* and 20*b*, horizontal member 21 and first and second diagonal members 22*a* and 22*b* may be hollow and some portion of cables 23 may be stored inside these hollow portions. To facilitate placing cables 23 inside horizontal member 21 and first and second diagonal members 22*a* and 22*b*, at least part of horizontal member 21 and first and second diagonal members 22*a* and 22*b* may be left open.

In another aspect, horizontal member 21 and first and second diagonal members 22*a* and 22*b* may be segmented and horizontal member 21 and first and second diagonal members 22*a* and 22*b* may be hinged and folded or may be telescoping (not shown).

In one aspect, space within the hollow portion of horizontal member 21 and first and second diagonal members 22*a* and 22*b* not occupied by cables 23 may be filled with foam. In another aspect, horizontal member 21 and first and second diagonal members 22*a* and 22*b* may have external clips or rings which support cables 23 (not shown).

In other aspects, raising/lowering mechanism 25 may be operated using any suitable mechanism, for example, electric motor, manually driven actuator, linear actuator, cam and follower, screw-jack, linkage, pneumatics, hydraulics, and control system. The gas springs may be replaced with torsion springs, compression springs, tension springs, a mass and lever arm, or other counter-balance means.

Figure 12A:
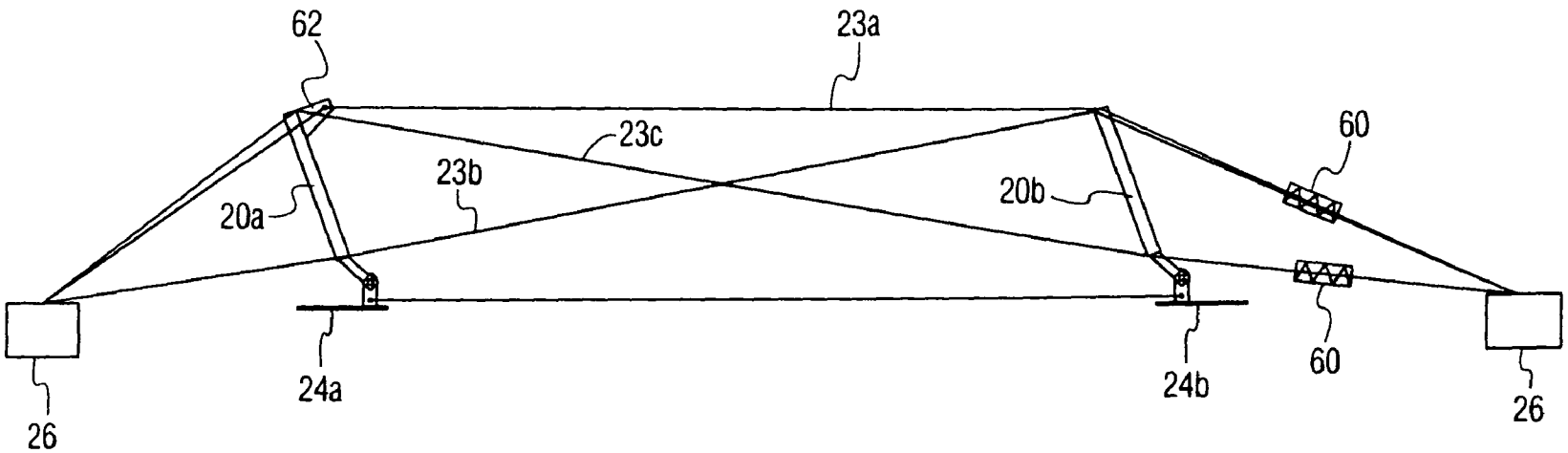
FIGS. 12A and 12B show front views of an enhanced vehicle barrier system with a tensioning device and without a horizontal member or first and second diagonal members, in raised and lowered positions, respectively, according to a second aspect of the present disclosure.
Figure 12B:
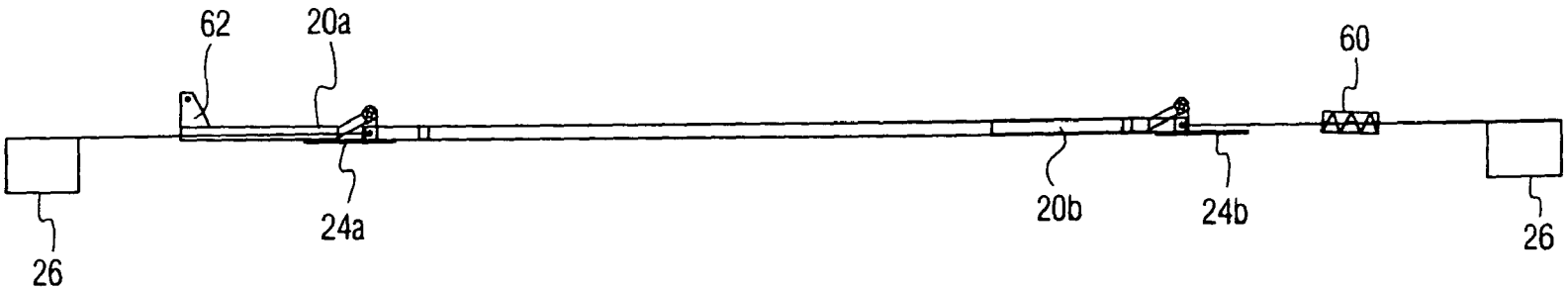

FIGS. 12A and 12B show front views of an enhanced vehicle barrier system, in raised and lowered positions, respectively, according to a second aspect of the present disclosure. This second aspect is similar to the first aspect shown in FIGS. 1A and 1B, but without the horizontal member 21 and diagonal members 22*a* and 22*b* and with the first arm 20*a* located on the opposite base 24*a*. A control horn 62 may be added to a distal end of the first arm 20*a*. The control horn 62 provides a connection point off-center (a moment arm) from the pivot point at the base of the arm, which provides for a force applied to the cable 23 to raise or lower the arm. Cables 23*a*, 23*b*, and 23*c* may be mechanically coupled on either side to anchors 26 using, for example, a heavy-duty D-link (not shown). Cable 23*a* may connect to both anchors and extend horizontally from connections at the distal end of both arms. Cable 23*b* and 23*c* may connect to both anchors and extend from a connection at the base of one arm to a connection at the distal end of another arm. For the embodiment shown in FIGS. 12A and 12B, and the other embodiments discussed in this disclosure, the cable 23 connections to the arms and anchors may be pulleys or pin joints (not shown). A tensioning device 60 may be added to the cables 23 to facilitate clearing the cables 23 from the area around the raising/lowering mechanism (not shown) and also may tension the cables to a desired amount for impact. Such tensioning device may include an in-line tension spring, a spring with a pulley end, a tension arm with a torsion spring, or may utilize an elastic stretch of the cable.

Figure 13A:
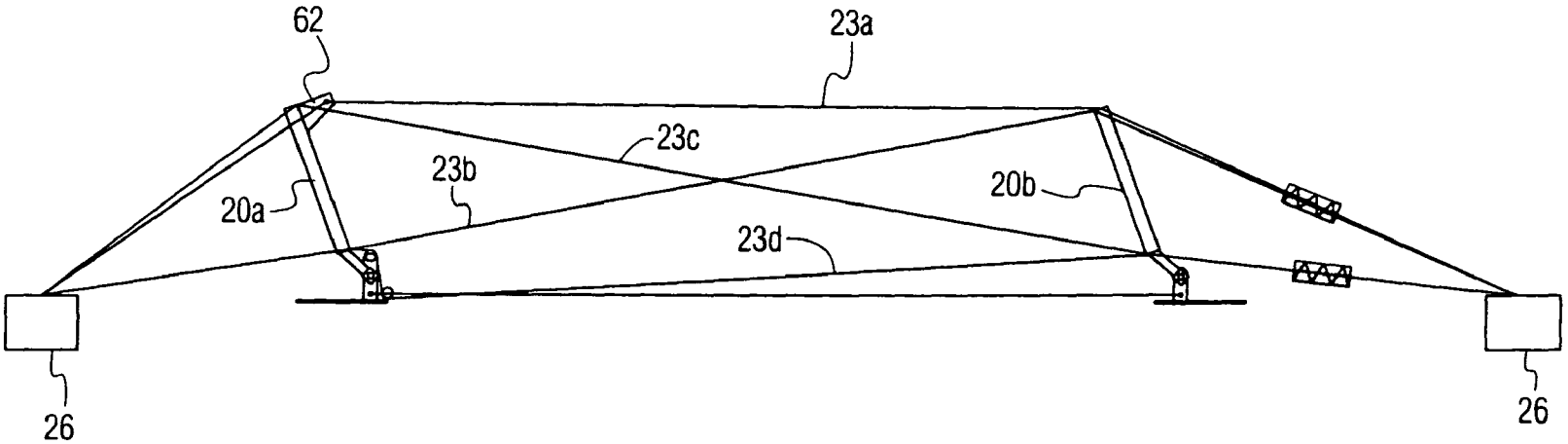
FIGS. 13A and 13B show front views of an enhanced vehicle barrier system with a tensioning device and without a horizontal member or first and second diagonal members, in raised and lowered positions, respectively, according to a third aspect of the present disclosure.
Figure 13B:
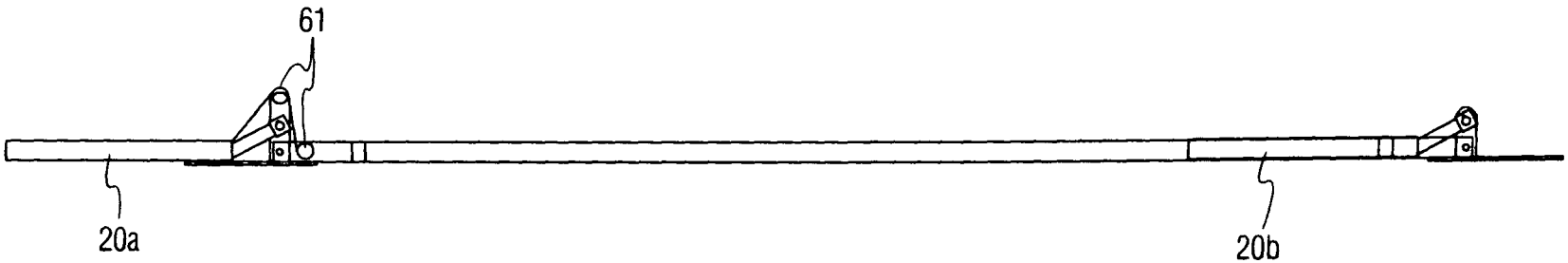

FIGS. 13A and 13B show front views of an enhanced vehicle barrier system, in raised and lowered positions, respectively, according to a third aspect of the present disclosure. This aspect is similar to the second aspect shown in FIGS. 12A and 12B with an alternate raising/lower method utilizing a drive cable 23*d* and a pulley 61. The drive cable 23*d* connects a raising/lowering mechanism (not shown) on base 24*a* with a second arm 20*b* located on the opposite side and coupled to base 24*b*. The pulley 61 in communication with drive cable 23*d* helps to facilitate matching the raising and lowering of the second arm 20*b* with the raising and lowering of the first arm 20*a*.

Figure 14A:
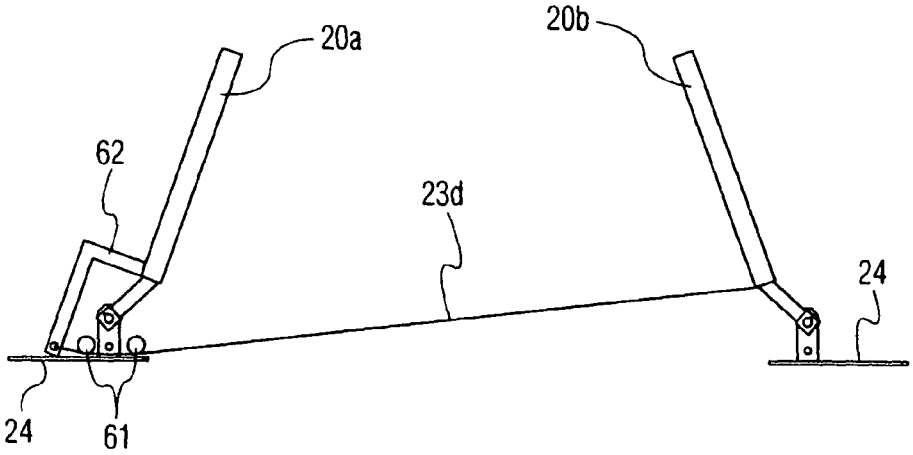
FIGS. 14A and 14B show front views of an enhanced vehicle barrier system without a horizontal member or first and second diagonal members, in raised and lowered positions, respectively, according to a fourth aspect of the present disclosure.
Figure 14B:
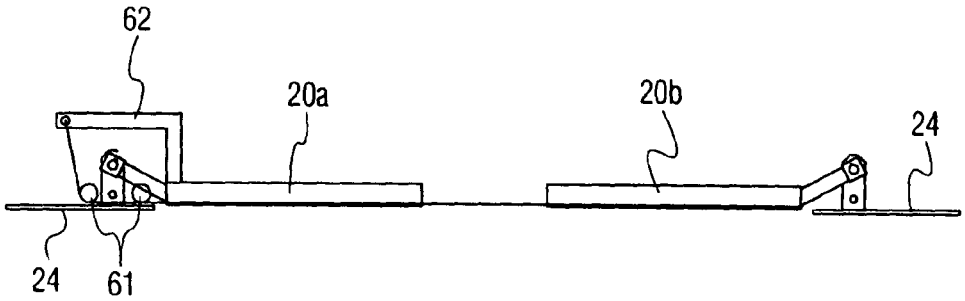

FIGS. 14A and 14B show front views of an enhanced vehicle barrier system, in raised and lowered positions, respectively, according to a fourth aspect of the present disclosure. This aspect is similar to the second aspect shown in FIGS. 13A and 13B with yet another alternate raising/lower method utilizing a control horn 62 coupled to the bottom end of arm 20*a*. The raising/lowering mechanism is coupled to a first arm 20*a* via the drive cable 23*d* and a pulley 61*a* and also coupled to a second arm 20*b* via the drive cable 23*d* and a pulley 61*b*.

Figure 15A:
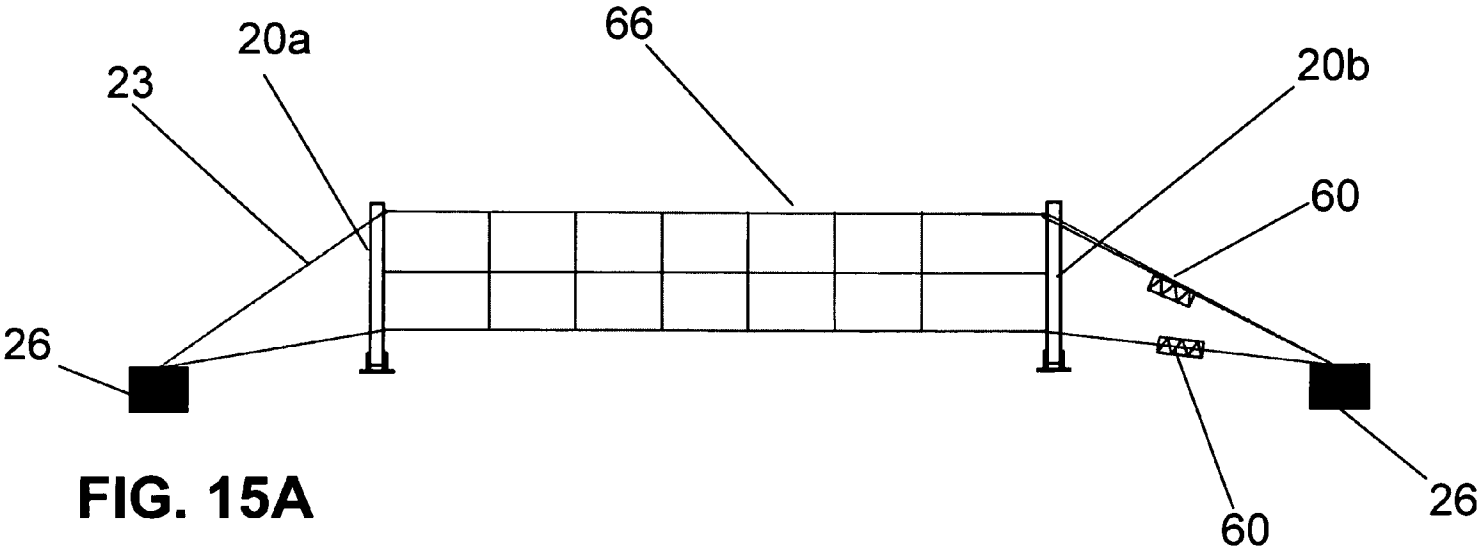
FIGS. 15A and 15B show front views of an enhanced vehicle barrier system without a horizontal member or first and second diagonal members, in raised and lowered positions, respectively, according to a fifth aspect of the present disclosure.
Figure 15B:
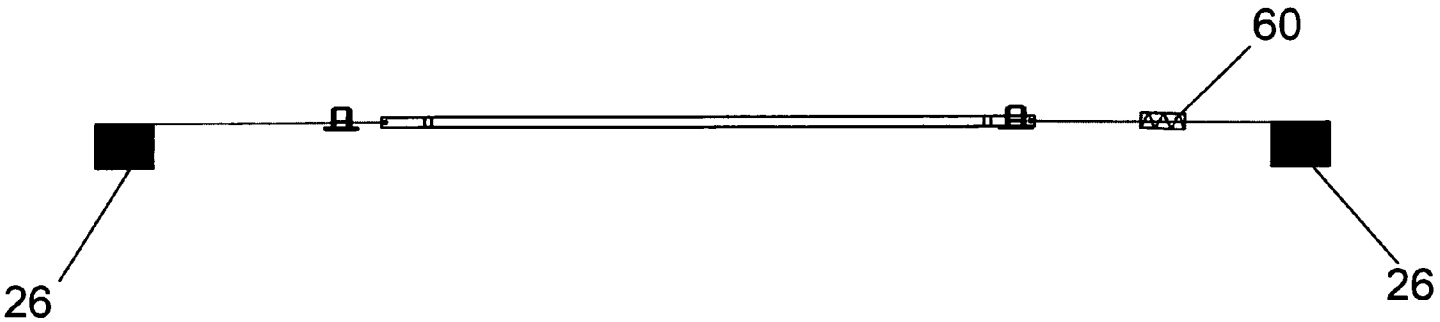

FIGS. 15A and 15B show front views of an enhanced vehicle barrier system, in raised and lowered positions, respectively, according to a fifth aspect of the present disclosure. The first and second arms 20*a* and 20*b*, raise and lower in a direction parallel to the roadway across which a net 66 is stretched. The net 66 can be constructed of metal cables, rope, or strapping made of fabric, plastic or rubber. The cables 23 are attached to anchors 26 and to the first and second arms 20*a* and 20*b*. The cables 23 may be attached to the arms with a pulley type connection (not shown). A tensioning device 60 may be added to the cables 23 to facilitate clearing the cables 23 from the area around the raising/lowering mechanism (not shown) and also may tension the cables to a desired amount for impact.

Figure 15C:
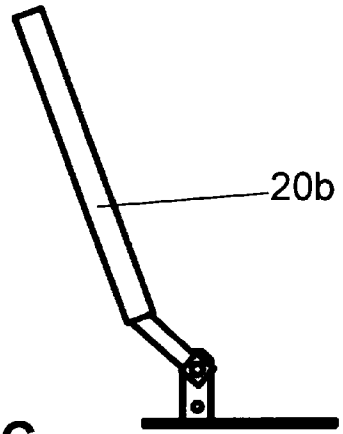
FIGS. 15C and 15D show side views of an enhanced vehicle barrier system without a horizontal member or first and second diagonal members, in raised and lowered positions, respectively, according to a fifth aspect of the present disclosure.
Figure 15D:
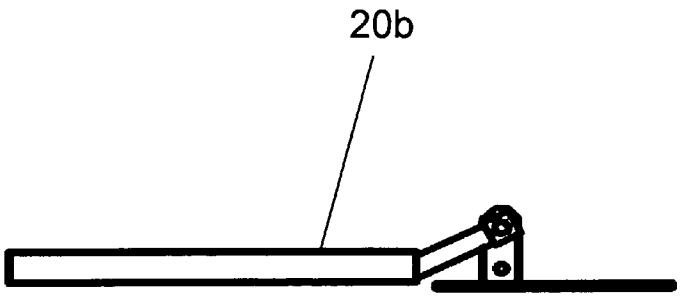

FIGS. 15C and 15D show side view of the enhanced vehicle barrier system, in raised and lowered positions, respectively according to a fifth aspect of the present disclosure as shown in FIGS. 15A and 15B. Specifically, arm 20*a* is seen in a raised and lowered position.

Figure 16A:
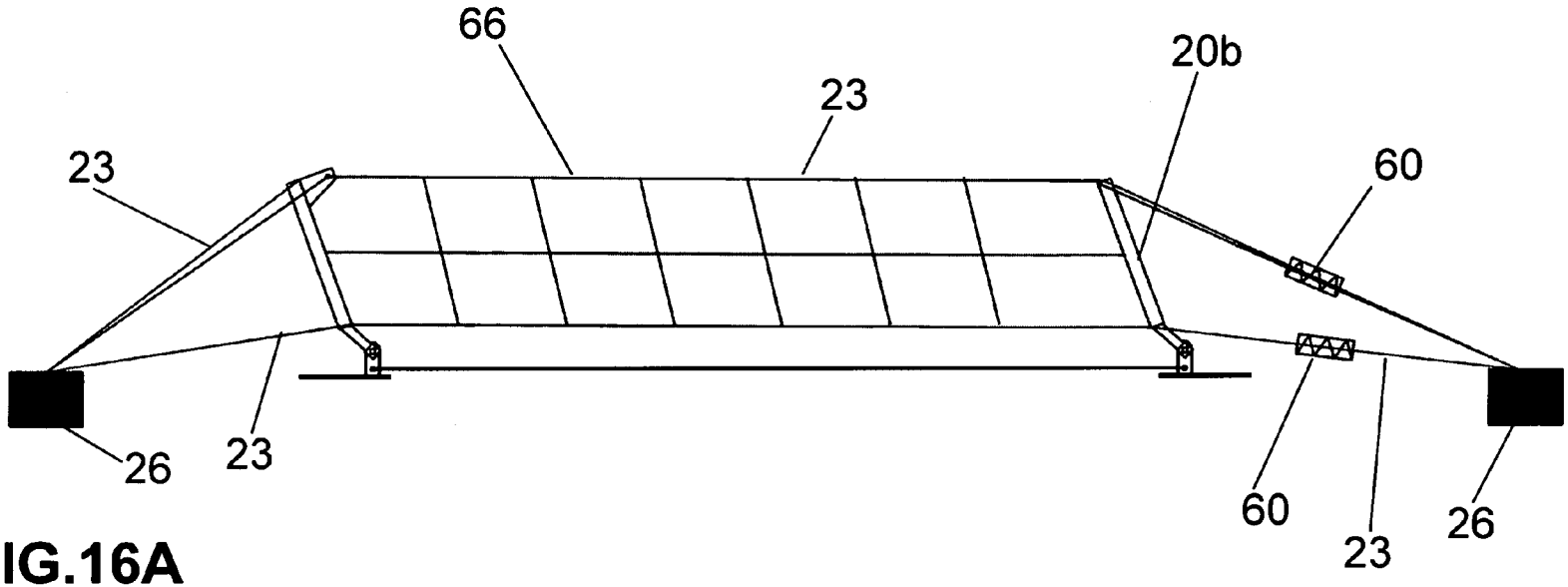
FIGS. 16A and 16B show front views of an enhanced vehicle barrier system without a horizontal member or first and second diagonal members, in raised and lowered positions, respectively, according to a sixth aspect of the present disclosure.
Figure 16B:
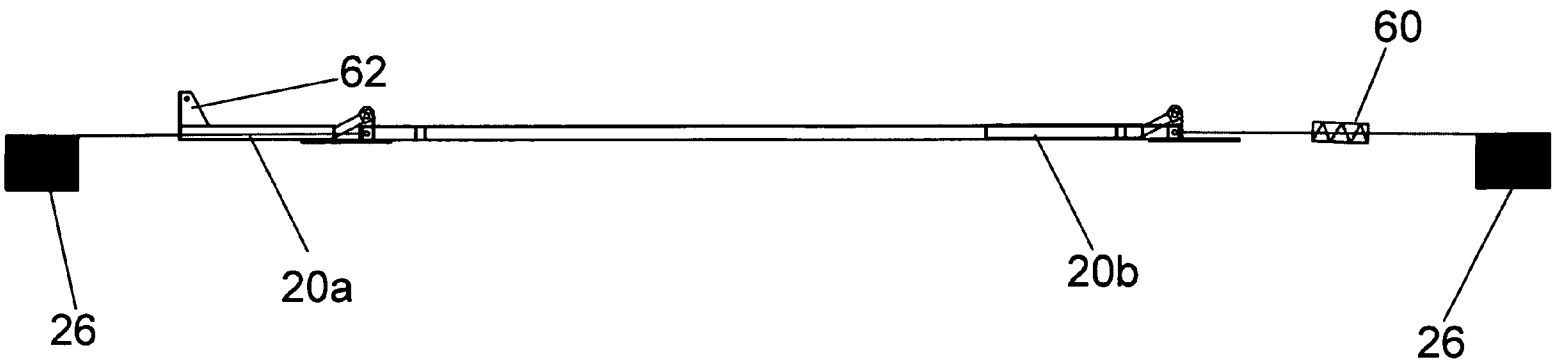

FIGS. 16A and 16B show front views of an enhanced vehicle barrier system, in raised and lowered positions, respectively, according to a sixth aspect of the present disclosure. The first and second arms 20*a* and 20*b*, raise and lower in a direction perpendicular to a roadway (not shown) across which a net 66 is stretched. The net 66 can be constructed of metal cables, rope, or strapping made of fabric, plastic or rubber. A control horn 62 may be added to a distal end of the first arm 20*a*. The cables 23 are attached to anchors 26 and to the first and second arms 20*a* and 20*b*. The cables 23 may be attached to the arms with a pulley type connection (not shown). A tensioning device 60 may be added to the cables 23 to facilitate clearing the cables 23 from the area around the raising/lowering mechanism (not shown) and also may tension the cables to a desired amount for impact. A top horizontal member of the net 66 may be a drive cable 23 for use in pulling up the arm 20*a* when raising the net 66.

Figure 17A:
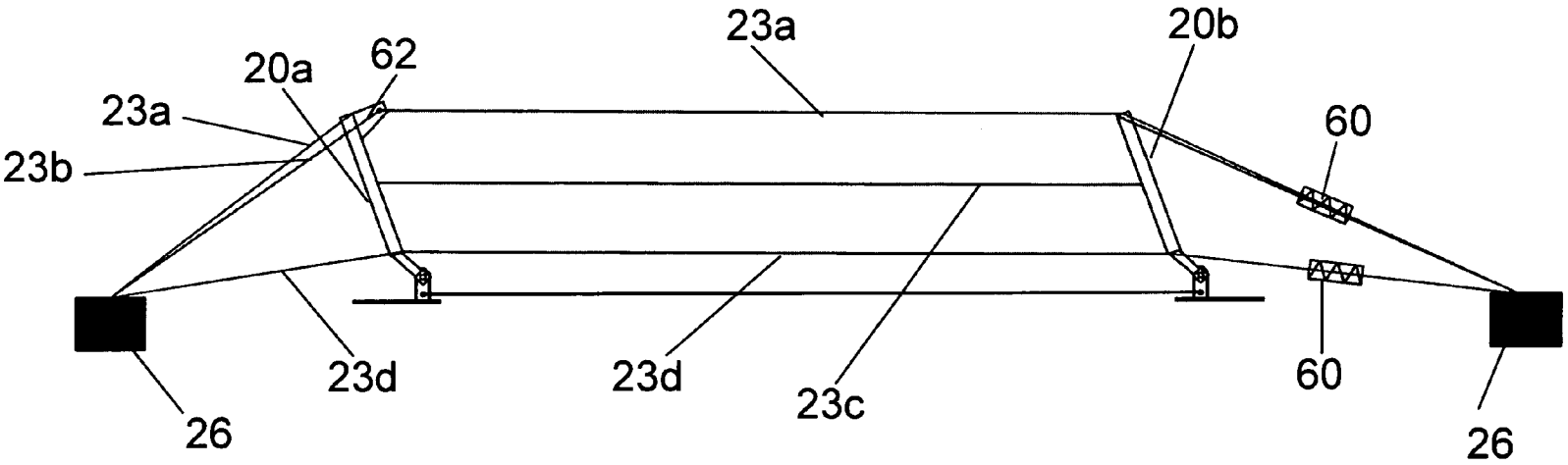
FIGS. 17A and 17B show front views of an enhanced vehicle barrier system without a horizontal member or first and second diagonal members, in raised and lowered positions, respectively, according to a seventh aspect of the present disclosure.
Figure 17B:
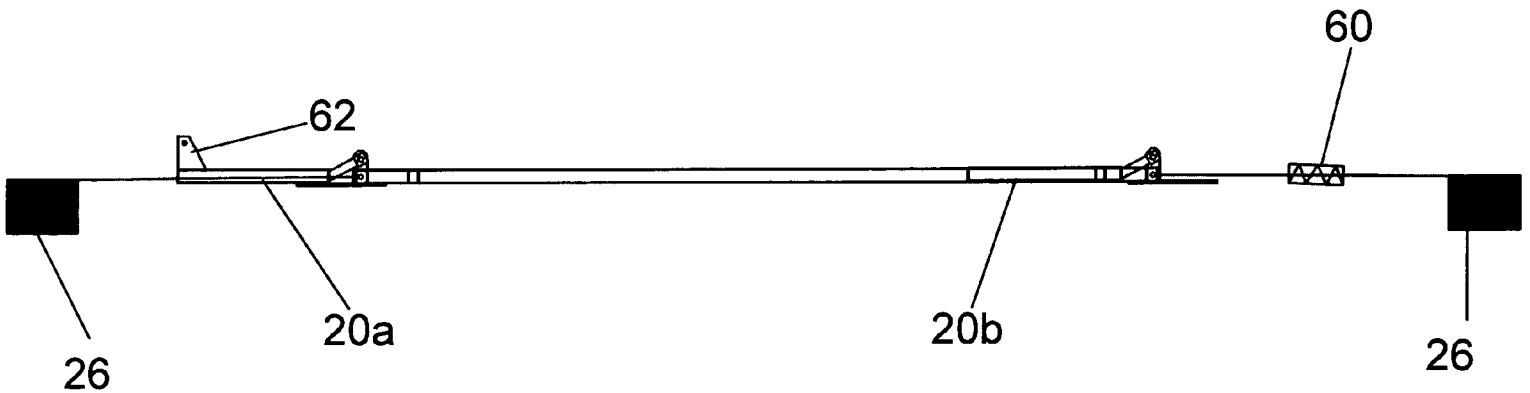

FIGS. 17A and 17B show front views of an enhanced vehicle barrier system, in raised and lowered positions, respectively, according to a seventh aspect of the present disclosure. The first and second arms 20*a* and 20*b*, raise and lower in a direction perpendicular to a roadway (not shown) across which a net 66 is stretched. A series of cables 23 can be connected horizontally between the arms 20*a* and 20*b*. A control horn 62 may be added to a distal end of the first arm 20*a*. The cables 23 are attached to anchors 26 and to the first and second arms 20*a* and 20*b*. The cables 23 may be attached to the arms with a pulley type connection (not shown). A tensioning device 60 may be added to the cables 23 to facilitate clearing the cables 23 from the area around the raising/lowering mechanism (not shown) and also may tension the cables to a desired amount for impact. A top cable 23*a* may be used to raise the arm 20*a* if the raising and lowering mechanism is coupled directly to arm 20*b* and indirectly to arm 20*a*.

FIGS. 12A-17B do not show a raising/lowering mechanism attached to the first and second arms 20*a* and 20*b*. It should be understood that a raising/lowering mechanism could be connected to either or both of the arms 20*a* and 20*b*. If the raising/lowering mechanism is directly connected to only one of the arms 20*a* or 20*b* in a manner similar to FIGS. 7-11, then such arm may be considered a primary arm. The other arm without direct connection to the raising/lowering mechanism may be considered a slave arm, and can be lifted through connection of cables or rigid members.

EXAMPLE

An example of the actual dimensions of a constructed prototype resembling the embodiment shown in FIGS. 1-11 is described as follows: Each of the arms 20*a* and 20*b*, the horizontal member 21 and the diagonal members 22*a* and 22*b* may have a 2"×3" cross-section. The arm 20*a* may be 34¾" long. The arm 20*b* may be 30¾" long. The diagonal members 22*a* and 22*b* may be 166" or 170" long. The pin 57 connecting diagonal members 22*a* and 22*b* is ideally located 18" to 24" above the roadway in order to contact the bumper of a vehicle, with a height of 21" being most preferred. The horizontal member 21 is ideally 44" above the roadway. The bases 24 may have a base area of 16"×36". The connecting linkages 45 may be 10.88" long. The connecting linkages and bases may be sprayed or coated with a durable bed-liner or powder to protect them from corrosion and damage from raising and lowering forces. The horizontal and diagonal members and arms may be made of aluminum, with the bases and connecting linkages made of steel. The linear actuators may be rated for 500 lbs and the gas springs rated for 250 or 450 lbs. The entire assembly may be disassembled and stored in a duffle bag that is about 4' long.

Although illustrative embodiments have been described herein in detail, it should be noted and will be appreciated by those skilled in the art that numerous variations may be made within the scope of this invention without departing from the principle of this invention and without sacrificing its chief advantages.

Unless otherwise specifically stated, the terms and expressions have been used herein as terms of description and not terms of limitation. There is no intention to use the terms or expressions to exclude any equivalents of features shown and described or portions thereof and this invention should be defined in accordance with the claims that follow.

What is claimed is:

1. An enhanced vehicle barrier system comprising:

a first base and a second base, located on opposite sides of an area through which a vehicle may pass;

a first arm and a second arm, each hingably mechanically coupled to the first base;

a first member hingably mechanically coupled to the first arm and extending in a direction across the area through which a vehicle may pass;

a second member hingably mechanically coupled to the second arm and hingably mechanically coupled to the second base;

a third member hingably mechanically coupled to the first member and hingably mechanically coupled to the first base;

a raising/lowering mechanism in mechanical communication with the first arm and the second arm; and a cable in mechanical communication with at least one of the first, second, and third members, the cable having connecting points located on opposite sides of the area through which a vehicle may pass, wherein the raising/lowering mechanism moves the first and second arms, thereby moving the first, second, and third members, and the cable between a first position and a second position, and wherein, when in the second position, at least portions of the first, second, and third members and the cable are high enough to encounter a front of a vehicle.

2. The enhanced vehicle barrier system of claim 1, wherein the first position is at or below ground level.

3. The enhanced vehicle barrier system of claim 1, wherein at least one of the first, second, and third members comprise a first portion mechanically coupled to a second portion, and the first and second portions are uncoupled upon application of at least a threshold force to one of the first and second portions.

4. The enhanced vehicle barrier system of claim 1, wherein the cable is supported by at least one of the first, second, and third members.

5. The enhanced vehicle barrier system of claim 4, further comprising a second cable supported by another one of the first, second, and third members.

6. The vehicle barrier system of claim 1, further comprising:

a ramp over which a vehicle may pass when the first, second, and third members are in the first position.

7. The enhanced vehicle barrier system of claim 1, wherein at least a portion of the first, second, and third members are hollow and store at least a portion of the cable.

8. The enhanced vehicle barrier system of claim 7, wherein the hollow portion of the first, second, and third members are accessible via a cover.

9. The enhanced vehicle barrier system of claim 1, wherein the raising/lowering mechanism includes a raising/lowering handle.

10. The enhanced vehicle barrier system of claim 1, wherein the raising/lowering mechanism includes at least one electric motor and a control system.

11. The enhanced vehicle barrier system of claim 1, wherein the raising/lowering mechanism includes at least one linear actuator.

12. The enhanced vehicle barrier system of claim 1, wherein the raising/lowering mechanism includes a piston, piston rod and cylinder, wherein the piston rod is mechanically coupled to the first and second arms.

13. The enhanced vehicle barrier system of claim 1, wherein the second member is mechanically coupled to the third member.

14. The enhanced vehicle barrier system of claim 13, wherein the second and third members are mechanically coupled and when in the second position substantially form the shape of an 'X'.

15. The enhanced vehicle barrier system of claim 1, wherein the first and third members extend substantially across the area through which a vehicle may pass.

16. The enhanced vehicle barrier system of claim 1, wherein both the first and second arms are positioned in a parallel arrangement.

17. The enhanced vehicle barrier system of claim 1, wherein the first and second arms are mechanically coupled to a release for disengaging the raising/lowering mechanism from the first and second arms.

18. The enhanced vehicle barrier system of claim 17, wherein the release is mechanically coupled to a release handle.

19. The enhanced vehicle barrier system of claim 1, wherein at least one gas spring is mechanically coupled to the first and second arms, wherein the at least one gas spring is also mechanically coupled to the base.

20. The enhanced vehicle barrier system of claim 1, wherein the first base and the second base are mechanically coupled.

21. The enhanced vehicle barrier system of claim 20, wherein the first and second bases are mechanically coupled by at least one connecting linkage.

* * * * *